US010497259B2

(12) United States Patent
Liu et al.

(10) Patent No.: US 10,497,259 B2
(45) Date of Patent: Dec. 3, 2019

(54) TRAFFIC SIGNAL CONTROL USING VEHICLE TRAJECTORY DATA

(71) Applicant: The Regents of the University of Michigan, Ann Arbor, MI (US)

(72) Inventors: Xianghong Liu, Ann Arbor, MI (US); Jianfeng Zheng, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 0 days.

(21) Appl. No.: 15/947,454

(22) Filed: Apr. 6, 2018

(65) Prior Publication Data

US 2018/0293884 A1 Oct. 11, 2018

Related U.S. Application Data

(60) Provisional application No. 62/483,096, filed on Apr. 7, 2017.

(51) Int. Cl.
*G08G 1/08* (2006.01)
*G08G 1/01* (2006.01)

(52) U.S. Cl.
CPC ..... *G08G 1/08* (2013.01); *G08G 1/012* (2013.01); *G08G 1/0112* (2013.01); *G08G 1/0129* (2013.01); *G08G 1/0145* (2013.01)

(58) Field of Classification Search
CPC ..... G08G 1/08; G08G 1/012
USPC ..... 340/917
See application file for complete search history.

(56) References Cited

U.S. PATENT DOCUMENTS 6,662,141 B2 * 12/2003 Kaub ..... G08G 1/0104 340/907
2008/0094250 A1 * 4/2008 Myr ..... G08G 1/04 340/909
2014/0266798 A1 9/2014 Witte et al.
2016/0042641 A1 2/2016 Smith et al.
2016/0371973 A1 * 12/2016 Holleczek ..... G08G 1/0129
2017/0085632 A1 * 3/2017 Cardote ..... H04W 4/40
2017/0352263 A1 12/2017 Umehara et al.

FOREIGN PATENT DOCUMENTS

KR 1020110086323 A 7/2011
WO WO2014104869 A1 7/2014
WO WO2016136616 A1 9/2016

OTHER PUBLICATIONS

International Search Report on International application No. PCT/US2018/026559, dated Jul. 27, 2018, 3 pages.

* cited by examiner

*Primary Examiner* — Jack K Wang
(74) *Attorney, Agent, or Firm* — Reising Ethington P.C.

(57) ABSTRACT

A system and method for use in controlling traffic signaling devices located along public roadways. The method carried out by the system includes: receiving, at one or more computers, time-location (TL) data from a plurality of wirelessly connected devices traveling through an intersection of a public roadway; determining, by the one or more computers using the received TL data, a traffic volume estimation value representative of a volume of traffic at the intersection; and sending the traffic volume estimation value to a traffic signaling control system configured to control a traffic signaling device at the intersection based on the traffic volume estimation value.

12 Claims, 16 Drawing Sheets

| RxDevice | TxDevice | Gentime | Latitude | Longitude | Speed | Heading |
|---|---|---|---|---|---|---|
| 18013 | 35 | 281203941949171 | 42.30465 | -83.70778 | 4.78 | 88.4125 |
| 18013 | 35 | 281203942249243 | 42.30465 | -83.70776 | 4.7 | 88.7125 |
| 18013 | 35 | 281203942349227 | 42.30465 | -83.70776 | 4.66 | 88.4 |
| 18013 | 35 | 281203942449212 | 42.30465 | -83.70775 | 4.68 | 88.5 |
| 18013 | 35 | 281203942549207 | 42.30465 | -83.70774 | 4.68 | 88.5 |

*Figure 4*

| Time Stamp | Phase ID | Phase Status |
|---|---|---|
| 2015-9-1,0:6:48.837 | 2 | Red |
| 2015-9-1,0:6:48.837 | 2 | Red |
| 2015-9-1,0:6:48.837 | 1 | Green |
| 2015-9-1,0:6:48.837 | 1 | Green |

*Figure 5*

(a) Sample CV trajectories (b) Time dependent factor for 11AM-12 PM period (left) and 6 PM-7 PM period (right)

TRAFFIC SIGNAL CONTROL USING VEHICLE TRAJECTORY DATA

STATEMENT REGARDING FEDERALLY SPONSORED RESEARCH

This invention was made with government support under Grant Number DE-EE0007212 awarded by the US Department of Energy. The government has certain rights in the invention.

TECHNICAL FIELD

This invention relates to methods and systems for processing and using vehicular traffic data from connected vehicles to operate traffic control devices for increased efficiency of traffic flow.

BACKGROUND

Signalized intersections are indispensable parts of urban traffic networks. With tightening budgets and resources nowadays, maintaining efficient signal operation has become a challenging task for many traffic management agencies. Currently, many traffic control devices such as traffic signals in the U.S. are still fixed-time signals, which are not responsive to fluctuated traffic demands. For traffic signals to accommodate varying demands, vehicle detectors, e.g., inductance loop detectors or video detectors, need to be installed and maintained properly. This may inevitably incur significant cost for the public agencies.

Recently, connected vehicle (CV) technology has received significant attention with active efforts of pilot deployments supported by the US Department of Transportation (USDOT). Most of the existing studies mainly focus on scenarios where penetration rates of CVs must be at a certain level, which may not be feasible in the near future.

SUMMARY

In accordance with an aspect of the invention, there is provided a method for use in controlling traffic signaling devices located along public roadways, comprising the steps of:

(a) receiving, at one or more computers, time-location (TL) data from a plurality of wirelessly connected devices traveling through an intersection of a public roadway;

(b) determining, by the one or more computers using the received TL data, a traffic volume estimation value representative of a volume of traffic at the intersection; and (c) sending the traffic volume estimation value to a traffic signaling control system configured to control a traffic signaling device at the intersection based on the traffic volume estimation value.

In various embodiments, the method may include any of the following features or any technically-feasible combination of two or more of these features:

The method furthers include the step of receiving, at one or more of the computers, a status of a traffic signaling device located along the roadway; and step (b) further comprises determining, using the one or more computers, the traffic volume estimation value at the intersection based on the received TL data and on the received status of the traffic signaling device.

Step (b) further comprises determining a trajectory through the intersection for each of at least some of the wirelessly connected devices and determining the traffic volume estimation value based on the trajectories.

The determined trajectory includes a projected arrival time at the intersection, a departure time from the intersection, and a stop event indicator that indicates whether the vehicle stops at the intersection or moves through the intersection without stopping, and wherein step (b) further comprises determining the traffic volume estimation value using the arrival time, departure time, and stop event indicator for at least some of the wirelessly connected devices.

At least some of the wirelessly connected devices are vehicles traveling through the intersection and wherein step (b) further comprises determining the positions of some of the vehicles when stopped at the intersection and determining the traffic volume estimation value at least in part based on the positions.

At least some of the wirelessly connected devices are vehicles traveling through the intersection and wherein step (b) further comprises:

determining an event type for each of at least some of the vehicles, wherein the event type comprises either one of: the vehicle stopping at the intersection; or the vehicle passing through the intersection without stopping, and determining the traffic volume estimation value based at least in part on the event type.

The event type comprises one of: the vehicle stopping at the intersection; the vehicle passing through the intersection without stopping; the vehicle stopping at the intersection after another vehicle passes through the intersection without stopping during a single traffic light cycle; or the vehicle passing through the intersection without stopping after another vehicle passes through the intersection without stopping during a single traffic light cycle.

Step (a) further comprises receiving, for each of the wirelessly connected devices, the TL data as a series of trackpoints, each having location coordinates derived from global navigation satellite system (GNSS) radio signals along with time data indicating when the device was at a location represented by the location coordinates.

In accordance with another aspect of the invention, there is provided a computer-based system for use in controlling traffic signaling devices located along public roadways, comprising one or more computers that include one or more electronic processors and one or more computer programs stored on non-transitory computer-readable medium, the one or more computer programs being configured upon execution by the one or more processors to:

(a) receive time-location (TL) data from a plurality of wirelessly connected devices traveling through an intersection of a public roadway;

(b) determine using the received TL data, a traffic volume estimation value representative of a volume of traffic at the intersection; and (c) send the traffic volume estimation value to a traffic signaling control system configured to control a traffic signaling device at the intersection based on the traffic volume estimation value.

In accordance with yet another aspect of the invention, there is provided a method for use in controlling traffic signaling devices located along public roadways, comprising the steps of:

(a) receiving global navigation satellite system (GNSS) information that includes location and time data at a remote facility from a plurality of connected vehicles traveling along roadways that are interconnected at intersections;

(b) determining, for each of at least some of the plurality of connected vehicles, a trajectory using the GNSS information;

(c) receiving a set of traffic signal statuses, wherein the set of traffic signal statuses indicate the traffic signal status for traffic signals at at least some of the intersections, and wherein the one or more traffic signal statuses are each associated with a status time value;

(d) associating the trajectories with the set of traffic signal statuses according to the status time value and the time data from the GNSS information; and (e) determining a traffic volume estimation value based on the associated trajectories and set of traffic signal statuses.

In various embodiments, the method of the preceding paragraph may include any of the following features or any technically-feasible combination of two or more of these features:

Step (d) further comprises associating the trajectories with the traffic signal statuses of traffic signals at the intersections through which the trajectories pass according to the status time value and the time data from the GNSS information.

The determined trajectory for each vehicle includes a projected arrival time at the intersections traversed by the vehicle, a departure time from the traversed intersections, and a stop event indicator that indicates whether the vehicle stops at the traversed intersections or moves through the traversed intersections without stopping, and wherein step (e) further comprises determining the traffic volume estimation value using the arrival time, departure time, and stop event indicator for at least some of the wirelessly connected devices.

Step (e) further comprises determining the positions of some of the vehicles when stopped at the intersections through which the vehicles' trajectories pass and determining the traffic volume estimation value at least in part based on the positions.

Step (e) further comprises:

determining an event type for each of at least some of the vehicles, wherein the event type comprises either one of: the vehicle stopping at the intersections through which the trajectories pass; or the vehicle passing through those intersections without stopping, and determining the traffic volume estimation value based at least in part on the event type.

The event type comprises one of: the vehicle stopping at the intersection; the vehicle passing through the intersection without stopping; the vehicle stopping at the intersection following another vehicle passes through the intersection without stopping during a single traffic light cycle; or the vehicle passing through the intersection without stopping after another vehicle passes through the intersection without stopping during a single traffic light cycle.

Step (e) further comprises sending the traffic volume estimation value to a traffic signaling control system configured to control traffic signals at the intersections through which the trajectories pass based on the traffic volume estimation value.

BRIEF DESCRIPTION OF THE DRAWINGS

Preferred exemplary embodiments will hereinafter be described in conjunction with the appended drawings, wherein like designations denote like elements, and wherein:

FIG. 4 depicts example time-location data in the form of basic safety messages obtained at the roadside equipment of FIGS. 1A and 1B;

FIG. 5 depicts example traffic signal status information in the form of signal phase and timing data that is provided by the roadside equipment of FIGS. 1A and 1B;

DETAILED DESCRIPTION

Figure 1A:
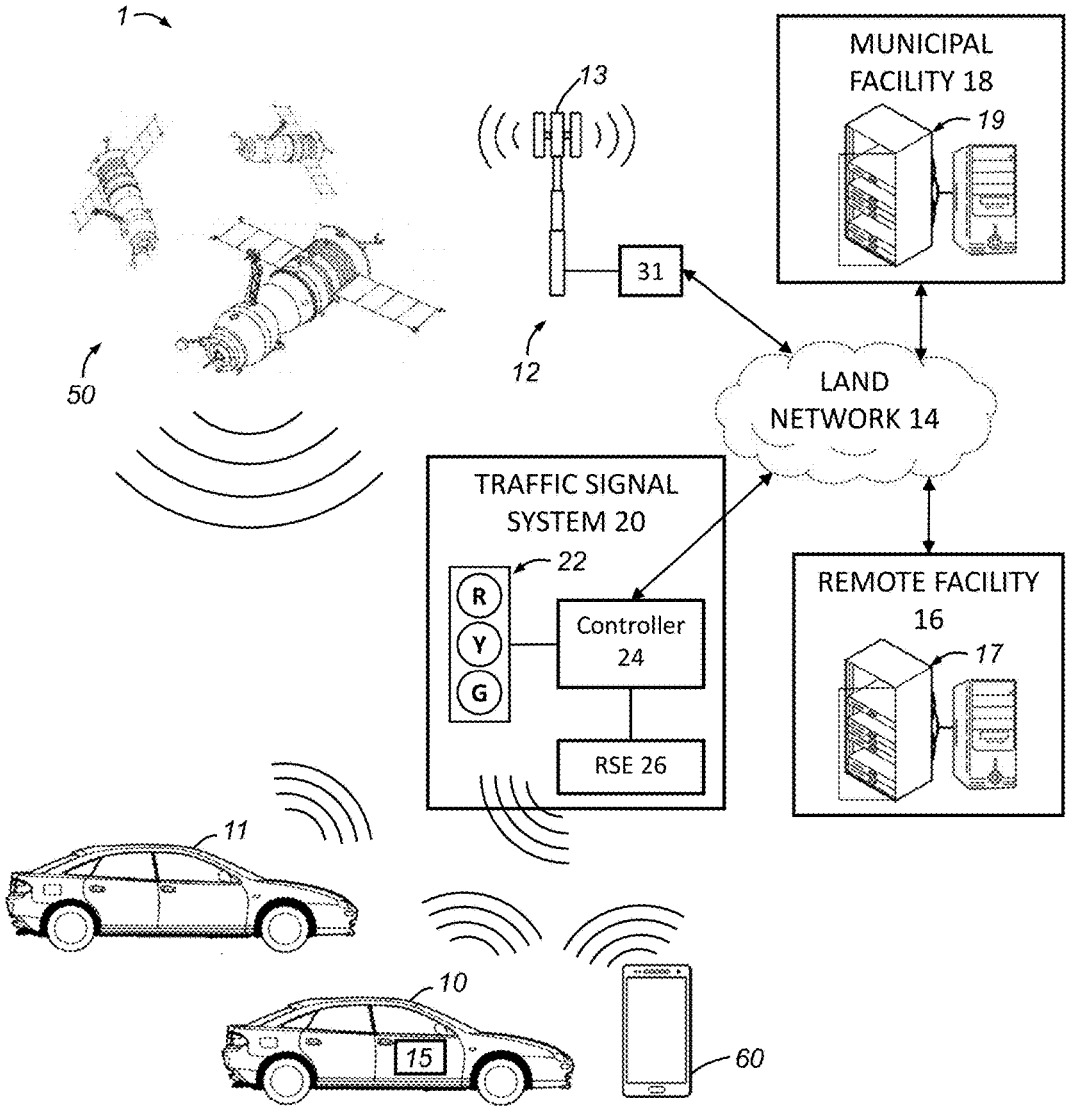
FIGS. 1A and 1B depict a communications system that includes a computer-based system and operating environment for carrying out the traffic estimation and traffic signal control methods discussed herein.

The system and method described herein enables traffic volume estimation and traffic signal control based on trajectory data of wirelessly connected devices (WCD), such as connected vehicles (CVs). Although the illustrated embodiment is described primarily as it would be implemented with CVs that utilize a global navigation satellite system (GNSS) for position information, it will be appreciated as the description proceeds that the system and methods discussed herein may be used with other WCDs such as a handheld wireless device having a GNSS receiver along with cellular and/or short range wireless communication (SRWC) capabilities.

The system and method described herein use time-location (TL) data that is received from a WCD. The TL data is data indicative of the global position of the connected device at one or more particular points in time. In at least some embodiments, the TL data may be one or more trackpoints comprising global position coordinates of the device along with time data representing when the device was at the location represented by the trackpoint(s). In the embodiments discussed herein, a GNSS receiver incorporated into the WCD is used to generate the global position data (i.e., GNSS information or data) that is used for the TL data, although other techniques for position determination may be used instead of or in addition to the use of GNSS information. The trackpoints or other global position data that is provided by each individual WCD may be generated by that device from received GNSS radio signals using whatever GNSS receiver is included in the device, and may be provided in NMEA format, GPX format, or otherwise. The TL data also includes time data indicative of when the WCD was at the position indicated by the global position data, and this time data may be provided by the GNSS receiver along with the global position data (e.g., as a UTC time included in a NMEA standard output format), or the time data may be provided in other ways or from other sources; for example, by a clock on the WCD or by a network over which the global position data is transmitted from the device to a central facility where the traffic volume estimation is carried out.

For any particular WCD, the TL data may be provided as a series of trackpoints or other global position data points along with time data that enables determination of the time at which the device was at some or all of the points. And when at least some of the data points in the series includes different positions for the device, then that series of TL data is representative of a trajectory of the device. The different trackpoints may be sent individually from the device as they are determined and then combined together at the central facility to determine the trajectory of the device. Or, they may be sent together as a track or other collection of TL data points. The TL data may include, or be sent with, a device identification (ID) so that different tracks or trackpoints or different pieces or groups of TL data may be associated with each other to determine the device trajectory. Techniques for doing this will be known to those skilled in the art.

Given that the TL data includes time data, the trajectory of a device may include time information indicating when the device was at the different points making up that trajectory. Thus, the trajectory may be used to determine or predict certain events and/or attributes associated with certain events, such as a projected arrival time at a particular intersection, the departure time from the intersection, as well as whether the vehicle or other device was stopped at the intersection or able to proceed through the intersection without a stop. As will be described below, those different types of trajectories may be used to determine an estimated traffic volume at the intersection.

In many embodiments, the GNSS-based trajectory data from CV or other WCD is used at low market penetration rates to estimate traffic volume, which can be a useful input to many signal optimization algorithms. In some instances, vehicle arrivals at signalized intersections can be modeled as a time-dependent Poisson process, which can account for signal coordination, and which can be used to estimate traffic volumes. The estimation problem is formulated as a maximum likelihood problem given multiple observed trajectories or other information from CVs approaching to the intersection. As used herein, the trajectory of a WCD refers to the track or path, actual or projected, of the WCD. This trajectory may also include a timestamp or other time data such as is typically included in NMEA-formatted messages. An expectation maximization (EM) procedure can be derived to aid in this estimation problem. Two case studies were conducted to validate the estimation technique. One uses the CV data from the Safety Pilot Model Deployment (SPMD) project, in which around 2,800 CVs were deployed in the City of Ann Arbor, Mich. The other uses vehicle trajectory data from users of a commercial navigation service in China. Mean absolute percentage error (MAPE) of the estimation was found to be 8% to 12%, based on benchmark data manually collected and data from loop detectors. Considering the existing scale of CV deployments, the proposed approach could aid traffic management agencies for evaluating and operating traffic signals, paving the way of using CVs for detector-free signal operation in the future.

Figure 1B:
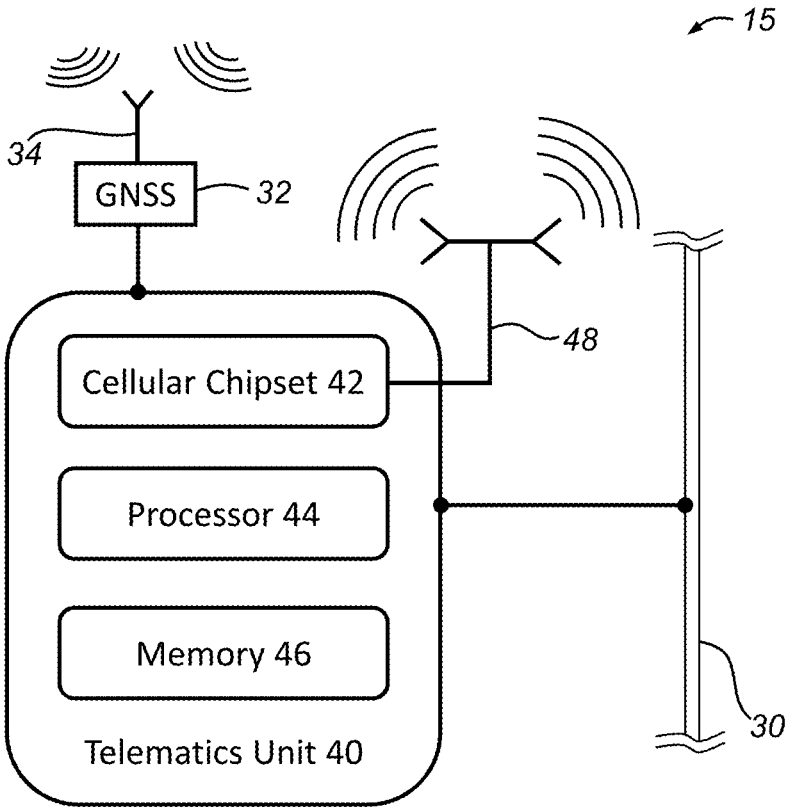

Referring now to FIGS. 1A and 1B, there is shown an operating environment that comprises a communications system 1 and that can be used to implement the method disclosed herein. Communications system 1 generally includes vehicles 10, 11 that may include a telematics unit 40 and a global navigation satellite system (GNSS) module 32, a constellation of GNSS satellites 50, one or more wireless carrier systems 12, a land communications network 14, a remote processing facility 16, a municipal facility 18, a traffic signal system 20 including a traffic signaling device 22, and mobile device 60. Vehicle-to-infrastructure (V2I) communications include communications that can be carried out between vehicles and remote networks, such as remote facility 16 and/or municipal facility 18. Such communication system may be one example that can carry out vehicle-to-infrastructure (V2I) communications. It should be understood that the disclosed method can be used with any number of different systems and is not specifically limited to the operating environment shown here. Also, the architecture, construction, setup, and operation of the system 1 and its individual components are generally known in the art. Thus, the following paragraphs simply provide a brief overview of one such communications system 1; however, other systems not shown here could employ the disclosed method as well.

Wireless carrier system 12 may be any suitable cellular telephone system. Carrier system 12 is shown as including a cellular tower 13; however, the carrier system 12 may include additional cellular towers as well as one or more of the following components (e.g., depending on the cellular technology): base transceiver stations, mobile switching centers, base station controllers, evolved nodes (e.g., eNodeBs), mobility management entities (MMEs), serving and PGN gateways, etc., as well as any other networking components required to connect wireless carrier system 12 with the land network 14 or to connect the wireless carrier system with user equipment (UEs, e.g., which include telematics equipment in vehicles 10, 11), all of which is indicated generally at 31. Carrier system 12 can implement any suitable communications technology, including for example GSM/GPRS technology, CDMA or CDMA2000 technology, LTE technology, etc. In general, wireless carrier systems 12, their components, the arrangement of their components, the interaction between the components, etc. is generally known in the art.

Apart from using wireless carrier system 12, a different wireless carrier system in the form of satellite communication can be used to provide uni-directional or bi-directional communication with the vehicle. This can be done using one or more communication satellites (not shown) and an uplink transmitting station (not shown). Uni-directional communication can be, for example, satellite radio services, wherein programming content (e.g., news, music) is received by the uplink transmitting station, packaged for upload, and then sent to the satellite, which broadcasts the programming to subscribers. Bi-directional communication can be, for example, satellite telephony services using the one or more communication satellites to relay telephone communications between the vehicles 10, 11 and the uplink transmitting station. If used, this satellite telephony can be utilized either in addition to or in lieu of wireless carrier system 12.

Land network 14 may be a conventional land-based telecommunications network that is connected to one or more landline telephones and connects wireless carrier system 12 to remote facility 16. For example, land network 14 may include a public switched telephone network (PSTN) such as that used to provide hardwired telephony, packet-switched data communications, and the Internet infrastructure. One or more segments of land network 14 could be implemented through the use of a standard wired network, a fiber or other optical network, a cable network, power lines, other wireless networks such as wireless local area networks (WLANs), or networks providing broadband wireless access (BWA), or any combination thereof.

Remote facility 16 may be designed to provide the vehicle electronics, mobile device 60, and/or other WCDs with a number of different system back-end functions. Remote facility 16 may include various components and may include a wired or wireless local area network. Remote facility 16 may include traffic diagnostic system 17, which can include numerous computers, servers, databases, and other computing devices. Generally, remote facility 16 may receive and transmit data via a modem connected to land network 14. A database at the remote facility 16 (e.g., at traffic diagnostic system 17) can store vehicle information, trajectory data, GNSS information and other TL data, and any other data pertaining to WCDs. Data transmissions may also be conducted by wireless systems, such as IEEE 802.11x, GPRS, and the like. In one embodiment, traffic diagnostic system 17 and/or remote facility 16 may be used to implement at least part of the method disclosed herein. In such a case, traffic diagnostic system 17 may receive the TL and other data from vehicles 10, 11, mobile devices 60, and/or other WCDs. The remote facility 16 may then process this information and/or use the data to estimate traffic volumes, such as through generating a traffic volume estimation value. As discussed in more detail below, any one or more of the methods and/or equations below may be used to generate a traffic estimation value and/or other traffic diagnostic or predictive information. These estimated traffic volumes (e.g., the traffic volume estimation value) and/or other traffic information may then be sent to municipal facility 18 and traffic control system 19 via land network 14. In other embodiments, remote facility 16 and/or traffic diagnostic system 17 may generate additional data based at least in part of the traffic volume estimation value and/or TL data (e.g., trajectory data). This additional data may be sent to municipal facility 18 and/or traffic control system 19 as well.

Municipal facility 18 includes traffic signaling control system 19, which may include various computers, databases, servers, and other computing devices. Traffic signaling control system 19 may be used for controlling traffic signaling devices, such as traffic signal 22, or may be used for processing traffic-related data, including estimated traffic volumes (e.g., the traffic volume estimation value). In one embodiment, traffic signaling control system 19 can receive data from remote facility 16, such as estimated traffic volumes, and, then, may generate traffic control data that can be sent to traffic signals or other traffic signaling devices such as pedestrian cross-walk lights and lane direction and closure signals. Traffic signaling control system 19 may receive traffic information from one or more traffic sensors, such as inductance loop detectors and/or video detectors, or from other roadside equipment (RSE) 26 that may be located at or near intersections. In some embodiments, municipal facility 18 or traffic signaling control system 19 may receive information from vehicles 10, 11, mobile devices 60, and/or other WCDs via RSE 26 and land network 14. In other embodiments, municipal facility 18 or traffic signaling control system 19 may receive information from vehicles 10, 11, mobile devices 60, and/or other WCDs via cellular carrier system 12 and land network 14. In such embodiments, the municipal facility 18 and/or traffic signaling control system 19 may carry out at least part of the method herein.

In some embodiments, traffic diagnostic system 17 and traffic signaling control system 19 can be located at the same facility (e.g., remote facility 16 or municipal facility 18) and/or may be carried out using the same set of hardware, such as a group of servers or computers.

Either or both of remote facility 16 and municipal facility 18 can include a computer-based system having one or more servers or computers that include an electronic processor and memory. The processors can be any type of device capable of processing electronic instructions including microprocessors, microcontrollers, host processors, controllers, vehicle communication processors, and application specific integrated circuits (ASICs). The processors may execute various types of digitally-stored instructions, such as software or firmware programs stored in the memory, which enable the facility to provide a wide variety of services. For instance, the processors at the remote facility 16 may be configured to execute programs or process data to carry out at least a part of the method discussed herein. In one embodiment, the process can execute an application (e.g., computer program) that causes the processor to perform one or more of the method steps on the GNSS information or other TL data that is received from the one or more vehicles 10, 11, mobile devices 60, and/or other WCDs. The memory at remote facility 16 or municipal facility 18 can include powered temporary memory and/or any suitable non-transitory, computer-readable medium such as different types of RAM (random-access memory, including various types of dynamic RAM (DRAM) and static RAM (SRAM)), ROM (read-only memory), solid-state drives (SSDs) (including other solid-state storage such as solid state hybrid drives (SSHDs)), hard disk drives (HDDs), magnetic or optical disc drives, or other suitable memory that stores some or all of the software needed to carry out the various external device functions discussed herein.

Traffic signal system 20 is depicted as including traffic signal 22, controller 24, and roadside equipment (RSE) 26, but can include a network switch, additional RSEs, additional traffic signals or other types of traffic signaling devices, a router, a modem, other network interface controller or module, and/or a memory device. Any one or more of these components can be housed in the traffic signal and/or in a separate housing located near the traffic signal. In one embodiment, the controller 24 can include a processor and memory, and which is configured to operate the traffic signal, for example, by activating and deactivating signaling cues (e.g., any visual, audible, or other indicator or notification that can be perceived by an operator on a roadway near or at the signaling device). The memory device at traffic signal can be a memory management unit (MMU) and/or a non-volatile memory device, which can include powered temporary memory and/or any suitable non-transitory, computer-readable medium such as different types of RAM (random-access memory, including various types of dynamic RAM (DRAM) and static RAM (SRAM)), ROM (read-only memory), solid-state drives (SSDs) (including other solid-state storage such as solid state hybrid drives (SSHDs)), hard disk drives (HDDs), magnetic or optical disc drives, or other suitable memory that stores some or all of the software needed to carry out the traffic signal communication and other operations.

Traffic signal system 20 can also include one or more network interfaces (including any suitable hardware, such as network interface cards (NIC) or wireless NIC) and may be able to communicate with one or more remote servers via land network 14. Also, traffic signal system 20 can include other network capabilities, such as cellular or other wireless communication capabilities, such as is indicated for RSE 26. The traffic signal can be send traffic signal status information or data to a remote facility, such as remote facility 16 or municipal facility 18. As used herein, traffic signal status refers to the operation of traffic cues of a traffic signal, such as whether a traffic light is green, red, or yellow (or amber). The traffic signal status can include a unique identifier (ID) used to identify the particular intersection at which the traffic signal is located, as well as time data that provides a time or a range of times in which the signal status refers to and/or is associated with. Although only one traffic signal system 20 is depicted, numerous traffic signal systems may be used and each may include one or more traffic signals 22 or other traffic signaling devices.

Traffic signal 22 is depicted as a stoplight or traffic light ("R" for red light, "Y" for yellow or amber light, and "G" for green light), but it should be appreciated that other traffic signaling devices can be used instead, such as any electronic signaling device that may be used to indicate information to a vehicular or pedestrian user of the roadway. Additionally, although there is only one traffic signal shown, it should be appreciated that numerous traffic signals may be used in system 1 and/or traffic signal system 20, and that various types of traffic signaling devices may be used.

RSE 26 can be controlled by controller 24 and may include an inductance loop detector, a video detector, or other traffic-related equipment and/or sensors that may be situated along a roadside or near an intersection. The RSE 26 and/or controller 24 can include network communication interfaces, such as WNIC or NIC, and may communicate directly with one or more nearby vehicles, such as via short-range wireless communications (SRWC). Both the RSE 26 and the traffic signal 22 may be remotely controlled based on the traffic volume estimation produced by the disclosed methods, and may be reprogrammed or reconfigured such that the operation of signaling cues of the traffic signal is updated. For example, municipal facility 18 may send a set of instructions that can be used to update the traffic signal 22. The set of instructions can be referred to as an "update" and may be sent via land network 14, one or more cellular carrier systems 12, or other radio signals. In other embodiments, the traffic signal may be reprogrammed through a controller located at or near the traffic signal and that is connected to the traffic signal via a bus or other communication means.

Vehicles 10, 11 are depicted in the illustrated embodiment as a passenger car, but it should be appreciated that any other vehicle including motorcycles, trucks, sports utility vehicles (SUVs), recreational vehicles (RVs), bicycles, other vehicles or mobility devices that can be used on a roadway or sidewalk, etc., can also be used. As depicted in the illustrated embodiment, vehicle 10 includes a GNSS receiver or module 32 with its antenna 34 to receive GNSS radio signals from satellites 50. Vehicle 10 further includes a telematics unit 40 that enables communication between the vehicle and remote servers or network devices, such as those at remote facility 16. GNSS module 32 may be any suitable commercially available GNSS receiver and may provide NMEA or other output messages to telematics unit 40, which may then be sent as GNSS information/TL data from the vehicle 10. Vehicle 11 includes the same components, devices, and modules as vehicle 10, even though these components are not depicted.

Global navigation satellite system (GNSS) module 32 receives radio signals from the constellation of GNSS satellites 50. The GNSS module 32 can then generate TL data or other data that provides a location, which can then be used to identify known locations or a location of the vehicle. Additionally, GNSS module 32 may be used to provide navigation and other position-related services to the vehicle operator. Also, new or updated map data can be downloaded to the GNSS module 32 from the remote facility 16 via a vehicle telematics unit. The TL data can be supplied to remote facility 16 or other remote facility, such as municipal facility 18, for certain purposes, such as for traffic volume estimation or other traffic-related purposes. In some embodiments, the GNSS module 32 may be a global positioning system (GPS) module that receives GPS signals from GPS satellites that are a part of the US GPS satellite system. Receivers for use with GLONASS and/or Europe's Galileo system may also be used. The GNSS signals may be used to generate TL data that includes time data, and this time data may be the time when the GNSS module receives information from satellites 50, a time indicated in the GNSS signals received from the GNSS satellites 50, or other contemporaneous timestamp.

In one embodiment, vehicles 10, 11 may be configured to periodically send GNSS information/TL data to remote facility 16. For example, the vehicle may send this information to the remote facility every 100 ms. Additionally, the vehicle may send heading information (e.g., the direction the front of the vehicle is facing) or other vehicle or WCD information to the remote facility 16. As discussed above, once the remote facility 16 receives TL data from the vehicle 10 and/or vehicle 11, the remote facility 16 may store the information at a memory device and/or may process the data according to one or more set of computer instructions, such as computer instructions that may be configured to carry out at least part of the method described herein.

Telematics unit 40 includes a cellular chipset 42, a processor 44, a memory 46, and an antenna 48. Telematics unit 40 can be an OEM-installed (embedded) or aftermarket device that is installed in the vehicle and that enables wireless voice and/or data communication over wireless carrier system 12 and via wireless networking. This enables the vehicle to communicate with remote facility 16 and/or municipal facility 18, other telematics-enabled vehicles, or some other entity or device. The telematics unit preferably uses radio transmissions to establish a communications channel (a voice channel and/or a data channel) with wireless carrier system 12 so that voice and/or data transmissions can be sent and received over the channel. Telematics unit 40 receives GNSS information or other TL data from GNSS module 32 and, subsequently, sends such TL data to remote facility 16 or municipal facility 18. It may be connected to an intra-vehicle communications bus 30 that enables communication with other electronic systems on the vehicle. By providing both voice and data communication, telematics unit 40 enables the vehicle to offer a number of different services including those related to navigation, telephony, emergency assistance, diagnostics, infotainment, etc. Data can be sent either via a data connection, such as via packet data transmission over a data channel, or via a voice channel using techniques known in the art.

According to one embodiment, telematics unit 40 utilizes cellular communication according to either GSM, CDMA, or LTE standards and thus includes a standard cellular chipset 42 for voice communications like hands-free calling, a wireless modem for data transmission, an electronic processing device or processor 44, one or more digital memory devices 46, and a dual antenna 48. It should be appreciated that the modem can either be implemented through software that is stored in the telematics unit and is executed by processor 44, or it can be a separate hardware component located internal or external to telematics unit 40. The modem can operate using any number of different standards or protocols such as LTE, EVDO, CDMA, GPRS, and EDGE. Wireless networking between the vehicle, RSE 26, and other networked devices can also be carried out using telematics unit 40. For this purpose, telematics unit 40 can be configured to communicate wirelessly according to one or more wireless protocols, including short range wireless communication (SRWC) such as any of the IEEE 802.11 protocols, WiMAX™, ZigBee™, Wi-Fi Direct™, Bluetooth™, or near field communication (NFC). When used for packet-switched data communication such as TCP/IP, the telematics unit can be configured with a static IP address or can set up to automatically receive an assigned IP address from another device on the network such as a router or from a network address server.

Processor 44 can be any type of device capable of processing electronic instructions including microprocessors, microcontrollers, host processors, controllers, vehicle communication processors, and application specific integrated circuits (ASICs). It can be a dedicated processor used only for telematics unit 40 or can be shared with other vehicle systems. Processor 44 executes various types of digitally-stored instructions, such as software or firmware programs stored in memory 46, which enable the telematics unit 40 to provide a wide variety of services. For instance, processor 44 can execute programs or process data to carry out at least a part of the method discussed herein. In one embodiment, telematics unit 40 includes an application (e.g., computer program) that enables the processor to send GNSS information or other TL data to a remote facility 16. Memory 46 can include powered temporary memory and/or any suitable non-transitory, computer-readable medium such as different types of RAM (random-access memory, including various types of dynamic RAM (DRAM) and static RAM (SRAM)), ROM (read-only memory), solid-state drives (SSDs) (including other solid-state storage such as solid state hybrid drives (SSHDs)), hard disk drives (HDDs), magnetic or optical disc drives, or other suitable memory that stores some or all of the software needed to carry out the vehicle device functions discussed herein.

Furthermore, it should be understood that at least some of the aforementioned modules could be implemented in the form of software instructions saved internal or external to telematics unit 40, they could be hardware components located internal or external to telematics unit 40, or they could be integrated and/or shared with each other or with other systems located throughout the vehicle, to cite but a few possibilities. In the event that the modules are implemented as VSMs located external to telematics unit 40, they could utilize vehicle bus 30 to exchange data and commands with the telematics unit.

The mobile device 60 is a device that can communicate with other devices using cellular carrier system 12 and/or land network 14. Mobile device 60 can communicate with remote facility 16 and/or municipal facility 18, and is thus a wirelessly connected device (WCD). Additionally, mobile device 60 may communicate with vehicles 10, 11 and/or RSE 26 via short-range wireless communications (SRWC), such as Bluetooth™, Bluetooth Low Energy™ (BLE), Wi-Fi™, near field communications (NFC), or various other SRWC. Mobile device 60 may include: hardware, software, and/or firmware enabling such cellular telecommunications and SRWC as well as other mobile device applications. The hardware of the mobile device 60 may comprise: a processor and memory (e.g., non-transitory computer readable medium configured to operate with the processor) for storing the software, firmware, etc. The mobile device may also include a GNSS receiver or module, such as a module that is similar to GNSS module 32 that is included in vehicles 10, 11. The processor and memory may enable various software applications, which may be preinstalled or installed by the user (or manufacturer). One implementation of a vehicle-mobile device application may enable GNSS information to be sent to a remote facility 16. In one embodiment, a mobile device may be inside a vehicle cabin of a vehicle and, thus, may be used to send GNSS information or other TL data to a remote facility 16. Thus, a non-connected vehicle (e.g., a vehicle without a GNSS module and/or without capabilities to connect to remote facility 16 or municipal facility 18) transporting a cellular device or other WCD operates as a virtual connected vehicle and, in at least some embodiments, may thus be treated as a connected vehicle (CV).

Figure 2:
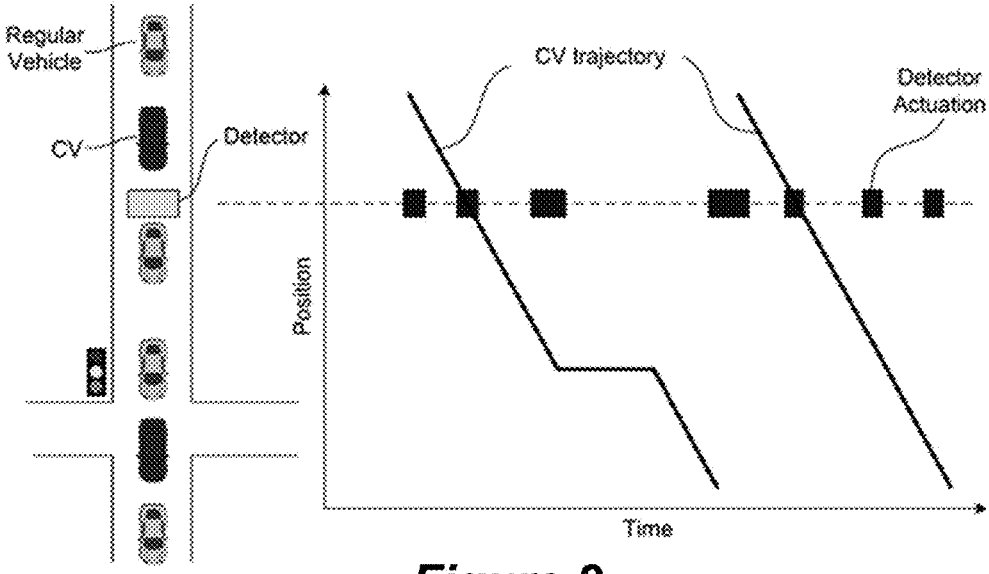
FIG. 2 illustrates both CV data and roadside detector data that may be acquired by the system of FIGS. 1A and 1B.

As mentioned above, in some embodiments, the methods and/or systems discussed herein can be used to estimate traffic arrivals at signalized intersections, including when CV penetration rates are low. As used herein, "penetration rates" refers to the ratio of connected vehicles to non-connected vehicles for a given location, area, or region. Traffic volumes can be useful inputs for designing and improving traffic signal operation. In conventional traffic signal systems, vehicle arrival information can only be obtained from detectors at fixed locations. Different from the detector data, CV data provide detailed trajectories, albeit currently only from a small percentage of vehicles. The comparison is illustrated in FIG. 2. One problem addressed by at least some embodiments herein is the estimation of overall arrival information using limited trajectory data provided by, or derived from, the TL data.

In some embodiments, traffic volume estimation can be accurately obtained through leveraging historical CV data and the repetitive patterns of vehicle arrivals at signalized intersections. Vehicle arrivals at intersections can be modeled as a time-dependent Poisson process with a time dependent factor characterizing arrival types. For volume estimation, an expectation maximization (EM) procedure can be derived that can incorporate different types of CV trajectories. To evaluate the performance of the proposed algorithm, two case studies were conducted: the first case study utilized real-world CV data received by a RSE in the SPMD project; the second case study utilized vehicle trajectory data from users of a route navigation service. In one embodiment, CV data can be used instead of traffic detectors that may be placed at traffic signals.

Figure 3:
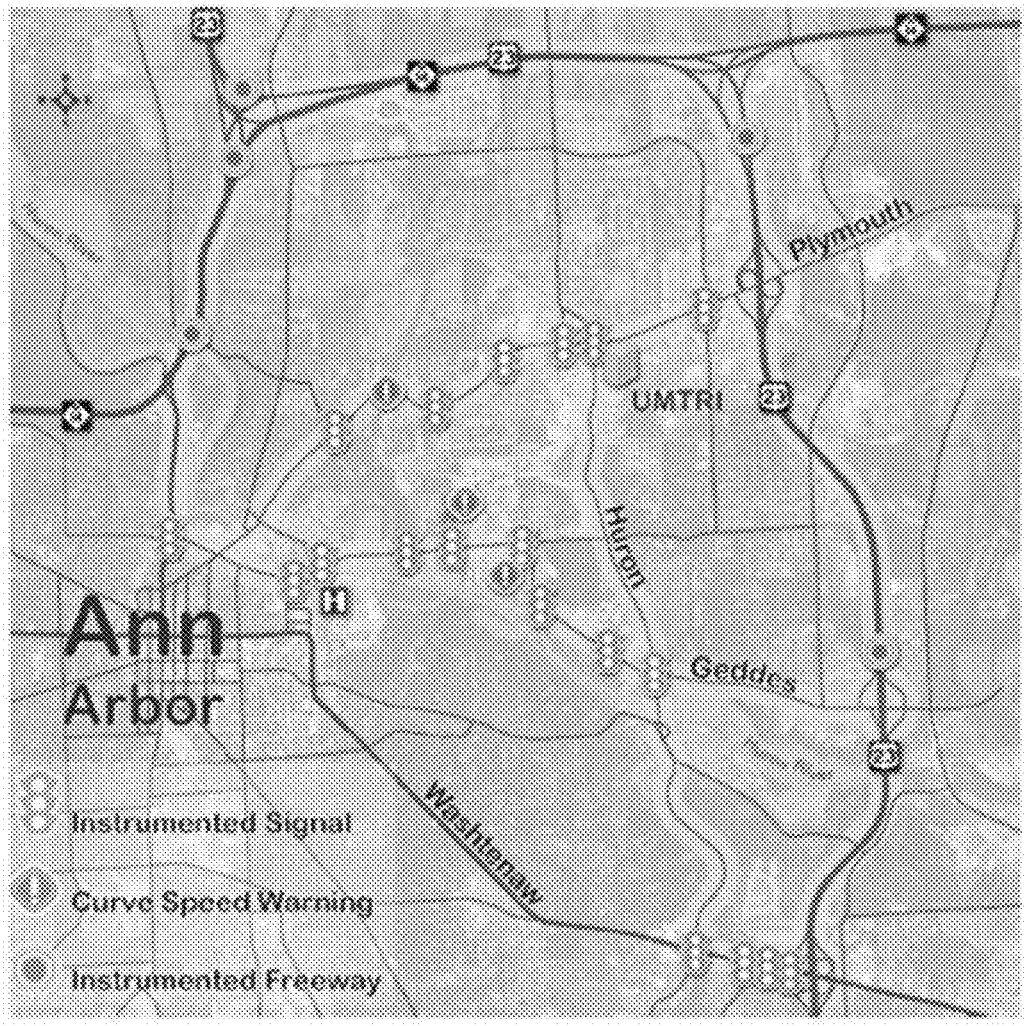
FIG. 3 depicts a sample deployment of roadside equipment for the system of FIGS. 1A and 1B.

Connected vehicle trajectory data and signal status data was collected in the SPMD project. The SPMD project was conducted by the University of Michigan Transportation Research Institute (UMTRI) for evaluating operation applicability of CV technology in a real-world, concentrated environment, and also for quantifying the benefits of CV safety applications and user acceptance. In the project, since August 2012, UMTRI has equipped about 2,800 vehicles with dedicated short range wireless communication (SRWC) devices and deployed RSEs at 27 locations including 19 intersections. An illustration of RSE deployment in the project is shown in FIG. 3. TL data in the form of basic safety messages (BSM) received by the RSEs have been continuously collected and archived in the UMTRI database.

A sample of processed BSM data (TL data) received by a RSE is shown in FIG. 4. A subset of data fields can be used, including device ID of a RSE (RxDevice), device ID of a CV sending the BSMs (TxDevice), GPS position and speed of the CV, and timestamp when the BSM was received by a RSE.

The signal phase and timing (SPaT) data broadcast by the RSEs have also been collected at deployed intersections. The SPaT data contain information of signal status that can be used as the input for "signal aware" CV applications, e.g., red light violation warning or eco-approach/departure assistance. Here, only a portion of the data fields in the SPaT are used, including: timestamp when a message was generated, signal phase ID and signal status. A sample of SPaT data is shown in FIG. 5.

Figure 6:
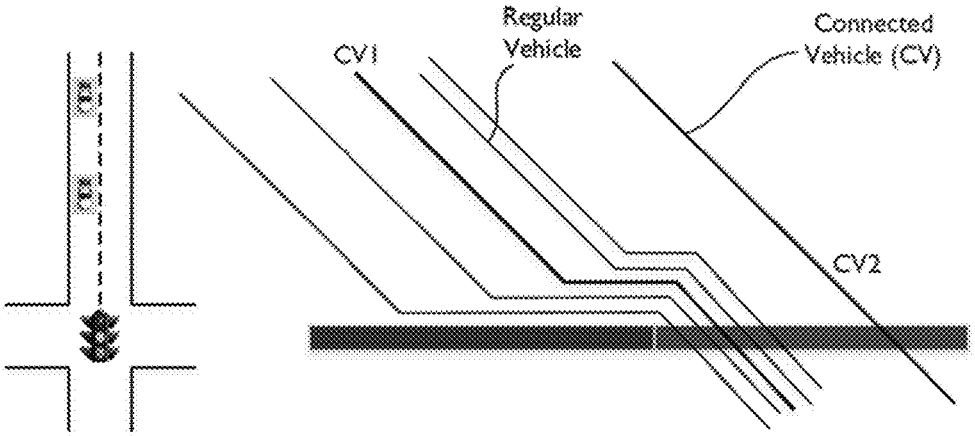
FIG. 6 depicts sample arrival information and shows trajectories of vehicles traversing an intersection.

Arrival information of a vehicle at a traffic signal can be reflected from the status of whether a vehicle stopped or not. An example is shown in FIG. 6. The arrival information can be calculated based on known locations of a traffic signaling device, trajectory information of a WCD (e.g., a CV), and/or a traffic signaling device status. In FIG. 6, CV1 (e.g., vehicle 10) passed the intersection with a stop and CV2 (e.g., vehicle 11) without a stop. Then, based on CV1's stopping position or departure time, the number of vehicles queuing in front of it can be calculated. For CV2, the vehicle queue is not long enough to impact CV2. In other words, the upper bound of possible vehicle arrivals between CV1 and CV2 can be calculated. By combining these arrival information from vehicle trajectories, volume of overall vehicle arrivals can be estimated.

For the traffic volume estimation method, the inputs include vehicle trajectories (e.g., which can be generated from two or more TL data) approaching to an intersection as well as traffic signal status (or statuses). In other embodiments, the estimation method can take into account other data, such as other TL data, data from RSEs, data from mobile devices, or data from other devices that may be in communication with the remote facility 16, which may carry out at least part of the method discussed herein. For a CV trajectory, the information being utilized includes its projected arrival time with free flow speed at the stop bar $t_{f,i}$, its departure time at the stop bar $t_{d,i}$, the type of event indicating whether a CV stopped or not $s_i$, and the subscript i as the index of the event. For each CV trajectory, the following vector may be defined:

$$X_i=(t_{f,i},t_{d,i},s_i)^T$$

For CV without a stop, the projected arrival time at stop bar is equal to the departure time, as: $t_{f,i}=t_{d,i}$. For a CV with a stop, its projected arrival time $t_{f,i}$ can be estimated as:

$$t_{f,i} = t_{s,i} + \frac{y_i}{v_f} \quad \text{(Equation 1)}$$

Where: $t_{s,i}$ is time when the CV came to a stop, $y_i$ is the distance of its stopping position to the stop bar, and $v_f$ is the free flow speed. To incorporate signal information, the red signals are treated as a type of event. Here, it is assumed that no residual queue exists at the start of red signal. With this assumption, the estimation is for non-saturated traffic conditions. For each red signal, the following vector may be defined:

$$X_j=(t_{f,j},t_{d,j},s_j)^T, \text{ with } t_{f,j}=t_{r,j},\ t_{d,j}=t_{g,j}$$

Where: $t_{r,j}$ is the time of red start for cycle j, and $t_{g,j}$ for green start for cycle j. Here, $s_j$ can be set as −1, indicating that this event is corresponding to a red signal. Denoting red signal as an event can provide, in some embodiments, for easier data processing so that an inter-arrival period between arrivals of CVs and a starting time of red signals can be calculated. These two vectors can be used as part of the input to the estimation process presented below.

During a selected Time of Day (TOD) period, the method assumes that traffic arrivals follow a time-dependent Poisson process with an arrival rate of $\lambda p(t^{(c)})$. Here, $t^{(c)}$ indicates time within a signal cycle, the superscript (c) indicates that the time is measured using a signal clock, λ denotes the mean arrival rate, and $p(t^{(c)})$ is the time dependent factor proportional to the arrival rate at $t^{(c)}$, i.e., the fraction of total arrivals at $t^{(c)}$ over the entire signal cycle. The Poisson process can be used to model traffic arrivals at intersections. The additional assumption that arrival rates are dependent on the time in a signal cycle is to account for impacts from signal coordination with which mean arrival rate could not be treated as a constant.

Defining $N(t_1, t_2)$ as the accumulative number of arrivals from time $t_1$ to $t_2$, $$N(t_1,t_2)\sim\text{Poisson}(\Lambda(t_1,t_2))$$

Where: $\Lambda(t_1, t_2)=\int_{t_1}^{t_2}\lambda p(C(t))dt=\lambda\int_{t_1}^{t_2}p(C(t))dt$, and $C:t\rightarrow t^{(c)}$, mapping the time of a day, t, to time in signal cycle clock, $t^{(c)}$.

By aggregating CV trajectories, the time dependent factor $p(t^{(c)})$ can be calculated based on the following equation:

$$p(t^{(c)}) = \frac{1}{N}\sum_{i=1}^{N} I\{C(t_{f,i}) = t^{(c)}\} \quad \text{(Equation 2)}$$

Where $I\{C(t_{f,i})=t^{(c)}\}$ is an indicator that is 1 if the projected arrival time is $t^{(c)}$, and 0 otherwise, and N is the total number of CV trajectories. For the ease of data processing, time is discretized with 1-sec interval.

Figure 7A:
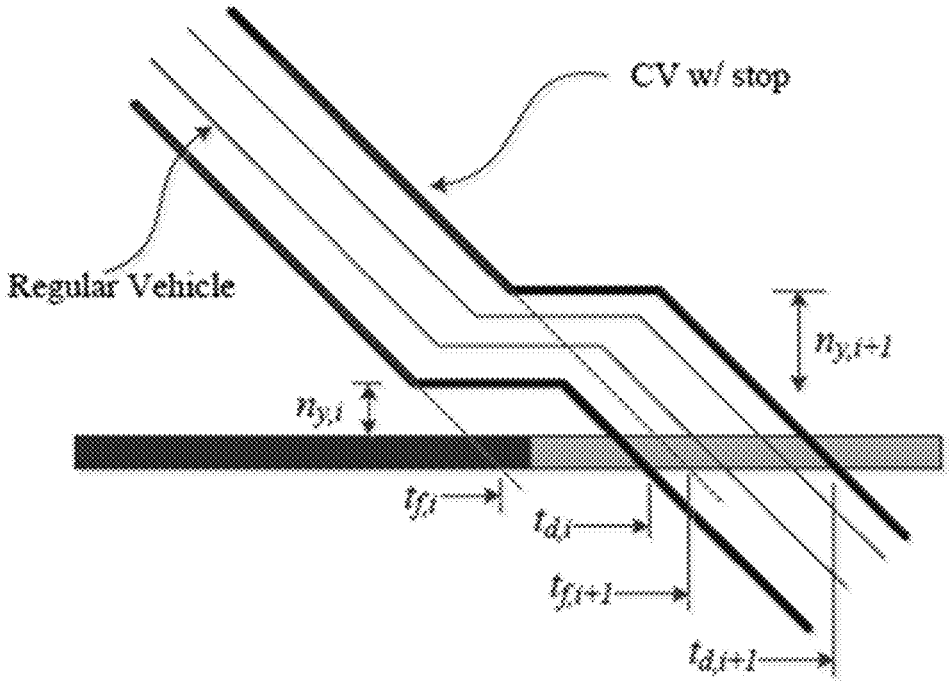
FIGS. 7A and 7B illustrate two different types of CV trajectories through an intersection.
Figure 7B:
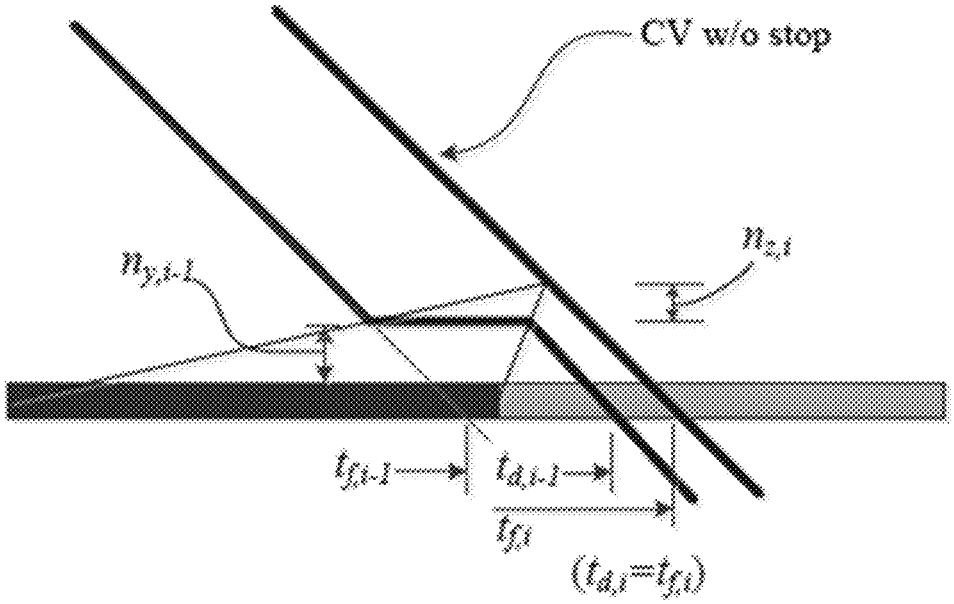

Given the Poisson arrival process, the likelihood function for observing all valid CV trajectories can be formulated by taking advantage of the inter-arrival time and the corresponding number of non-CV arrivals between two consecutive CV trajectories received at RSE. As mentioned earlier, two types of CV trajectories are considered: (1) CV trajectory with a stop at an intersection, and (2) CV trajectory that traverses the intersection without a stop. Between the projected arrival times of two stopped CVs, or between the projected arrival time of one stopped CV and the start of a red signal, the number of non-CV arrivals can be calculated based on the CVs' departure time. If a CV without a stop is observed, then it can be inferred or assumed that queues at intersection, if they exist, are not long enough to affect the non-stopped CV. Thus, the maximum number of vehicle arrivals before the CV can be calculated. Illustrations of the two types of CVs are shown in FIGS. 7A and 7B, along with notations for calculation later on.

$G(t_i, t_j)$ is defined as the effective green time from time $t_i$ to $t_j$. For each CV trajectory, the probability of occurrence can be calculated according to the following cases:

Case 1. If $s_i=1$, $s_{i-1}=-1$ or 1, indicating a CV trajectory with a stop is observed after red start or after the arrival of another stopped CV, then:

$$N(t_{f,i-1},t_{f,i})=n_{y,i},N(t_{f,i-1},t_{f,i})\sim\text{Poisson}(\lambda P_{y,i})$$

Where $$n_{y,i}=\left\lfloor\frac{G(t_{d,i-1},t_{d,i})}{h_s}\right\rfloor,$$

denoting the number of departures during the inter-arrival period $[t_{f,i-1}, t_{f,i}]$, $h_s$ is the saturated headway, and $$P_{y,i}=\frac{\Lambda(t_{f,i-1},t_{f,i})}{\lambda}=\int_{t_{f,i}}^{t_{f,i-1}}p(C(t))dt,$$

denoting accumulated time dependent factor, for simplifying notations. The subscript y denotes that the observations are stopped for CVs. The illustration is also shown in FIG. 7A.

Case 2. If $s_i=2$, $s_{i-1}=-1$ or 1, indicating a CV trajectory without a stop is observed after red start or after a stopped CV. Accordingly:

$$N(t_{f,i-1},t_{f,i})\leq n_{z,i},N(t_{f,i-1},t_{f,i})\sim\text{Poisson}(\lambda P_{z,i})$$

Where $$n_{z,i}=\left\lfloor\frac{G(t_{d,i-1},t_{d,i})}{h_s}\right\rfloor,\ P_{z,i}=\frac{\Lambda(t_{f,i-1},t_{f,i})}{\lambda}=\int_{t_{f,i}}^{t_{f,i-1}}p(C(t))dt.$$

The subscript z denotes that the observations are for non-stopped CVs. The illustration is also shown in FIG. 7B.

Besides these two cases, two other cases of trajectories also exist: (1) stopped CV arriving after a non-stopped CV in the same cycle, and (2) non-stopped CV arriving after another non-stopped CV, also in the same cycle. For the first case, the stop of the CV would not be caused by queues or red signal, but likely by other factors, e.g., mid-block entry of other vehicles. For the second case, after the arrival of a non-stopped CV, the queues must have been cleared and the rest of CVs in the same cycle would travel with free-flow speed. In these cases, and according to some embodiments, the trajectory information may not be used. Both of these cases may be considered as invalid or trivial observations and, at least in one embodiment, may not be used in the estimation.

Based on the discussion, the likelihood of observing all valid CV trajectories can be calculated with the following equation, with Y as the collection of observations for all stopped CVs, and Z for all non-stopped CVs.

$$L(Y,Z\mid\lambda)=\prod_{i=1}^{n}\left\{\frac{(\lambda P_{y,i})^{n_{y,i}}e^{-(\lambda P_{y,i})}}{n_{y,i}!}\right\}\prod_{j=1}^{m}\left\{\sum_{k=0}^{n_{z,i}}\frac{(\lambda P_{z,i})^{k}e^{-(\lambda P_{z,i})}}{k!}\right\}\quad\text{(Equation 3)}$$

Now, λ can be estimated for the traffic volume using maximum likelihood estimator (MLE). However, due to the summation inside the product operation in Equation 3, it may prove difficult to obtain a closed form of the MLE. Instead of seeking for a closed form, the Expectation Maximization (EM) algorithm for the estimation can be used. The Expectation Maximization (EM) algorithm is an iterative procedure to find the MLE mostly suitable when unobserved or partially observed variables exist. The EM algorithm consists of two main steps: the E-step and the M-step. The E-step calculates the conditional expectation of unobserved or partially observed variables based on initialized parameters, and the conditional expectation of the likelihood. Then, the M-step searches for an optimal update of the parameters through maximizing the likelihood. The two steps are iterated until updates converge. CV trajectories with stop can provide direct information of number of arrivals, while trajectories without a stop may provide information of upper bounds of the number of arrivals, which may be considered as partial information in some embodiments. Considering this, the EM algorithm would be a desirable choice for estimation, at least in some embodiments.

For the E-Step, denoting $\tilde{n}_{z,i}$ as the true value of accumulated number of arrivals by time $t_{z,i}$ corresponding to a CV trajectory without a stop, the log-likelihood for the complete data sequence is:

$$\begin{aligned}LL^{c}&=\sum_{i=1}^{n}\ln p(n_{y,i}\mid\lambda P_{y,i})+\sum_{i=1}^{m}\ln p(\tilde{n}_{z,i}\mid\lambda P_{z,i})\quad\text{(Equation 4)}\\&=\sum_{i=1}^{n}\left[\ln\frac{(\lambda P_{y,i})^{n_{y,i}}e^{-\lambda P_{y,i}}}{n_{y,i}!}\right]+\sum_{i=1}^{m}\left[\ln\frac{(\lambda P_{z,i})^{\tilde{n}_{z,i}}e^{-\lambda P_{z,i}}}{\tilde{n}_{z,i}!}\right]\\&=\sum_{i=1}^{n}[n_{y,i}(\ln\lambda+\ln P_{y,i})-\lambda P_{y,i}-\ln n_{y,i}!]+\sum_{i=1}^{m}[\tilde{n}_{z,i}(\ln\lambda+\ln P_{z,i})-\lambda P_{z,i}-\ln\tilde{n}_{z,i}!]\end{aligned}$$

Then, the expectation of the log-likelihood can be expressed as:

$$Q(\lambda\mid\lambda^{(s)})=E(LL^{(c)}\mid\lambda^{(s)})=C+\sum_{i=1}^{n}[n_{y,i}\ln\lambda-\lambda P_{y,i}]+\sum_{i=1}^{m}[\bar{n}_{z,i}\ln\lambda-\lambda P_{z,i}]\quad\text{(Equation 5)}$$

The conditional mean $\tilde{n}_{z,i}$ of the unobserved variable $\tilde{n}_{z,i}$, given observed is:

$$\bar{n}_{z,i}\mid n_{z,i},\lambda^{(s)}=\sum_{k=0}^{n_{z,i}}k\frac{\frac{(\lambda^{(s)}P_{z,i})^{k}}{k!}}{\sum_{l=0}^{n_{z,i}}\frac{(\lambda^{(s)}P_{z,i})^{l}}{l!}}\quad\text{(Equation 6)}$$

Finally, in the M-step, by setting the derivative of $Q(\lambda|\lambda^{(s)})$ with respect to λ as zero, the equation for updating λ is:

$$\lambda^{(s+1)} = \frac{\sum_{i=1}^{n} n_{y,i} + \sum_{i=1}^{m} \overline{n}_{z,i}}{\sum_{i=1}^{n} P_{y,i} + \sum_{i=1}^{m} P_{z,i}} \quad \text{(Equation 7)}$$

The equations 6 and 7 complete the EM iteration for the estimation.

Case Studies

To evaluate the proposed estimation algorithm, two case studies were conducted. The first case study utilized CV data received by a RSE in the SPMD project. The second case study utilized GPS data from users of a navigation service. These two types of data generally contain similar information. However, data from CV are in 10 Hz sampling frequency while data from navigation devices are in 1 Hz frequency. Also, the studied intersection in the first study was controlled by the SCOOT adaptive signal system, while in the second case study, the intersection was controlled by a fixed-time signal.

Case Study 1

Figure 8:
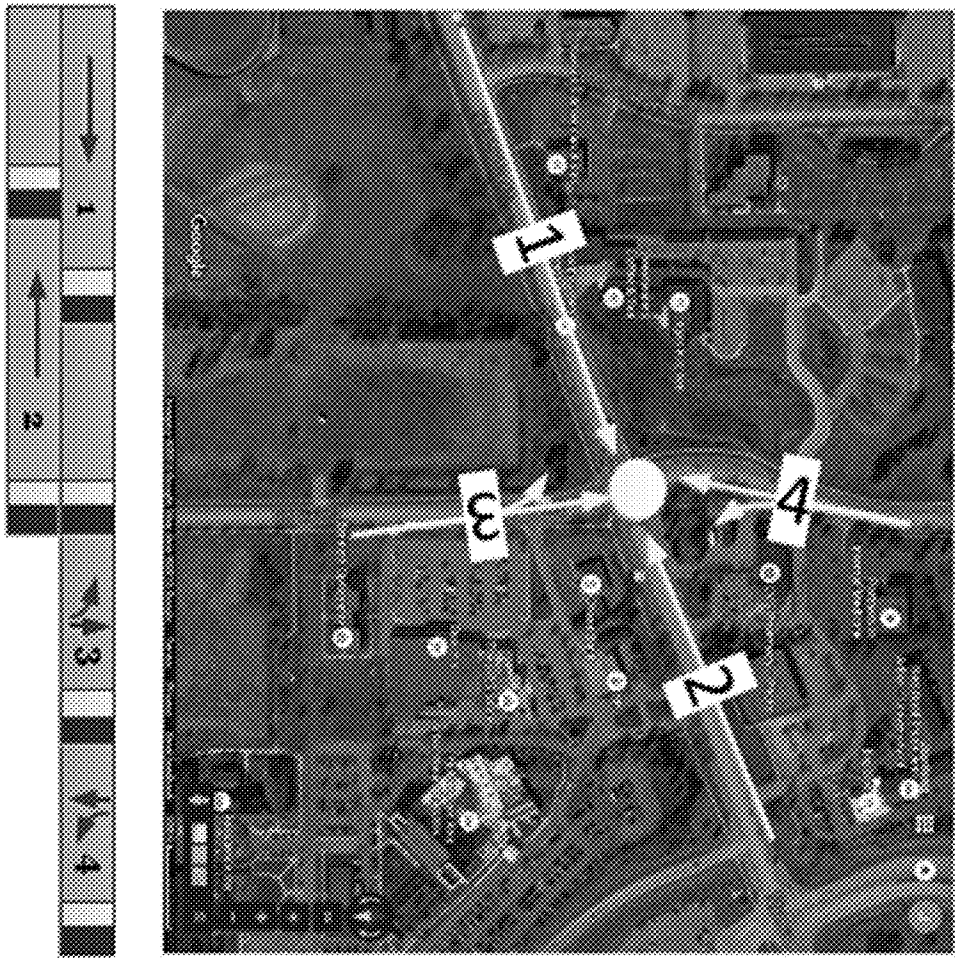
FIG. 8 shows one of the intersections of the sample deployment of FIG. 3 illustrating the different approaches to the intersection.

In the first case study, data was analyzed from Intersection of Plymouth Rd. & Green Rd., one of the deployed intersections in the SPMD project. CV data used were collected from Apr. 25, 2016 to May 13, 2016. An illustration of the intersection geometry is shown in FIG. 8, together with the ring-and-barrier diagram for traffic signal in operation. Here, the investigation focused only on eastbound (EB) through, westbound (WB) through, as well as southbound (SB) through and left-turn traffic, corresponding to phase 1, 2, and 4. The northbound (NB) approach is a single-lane road adjacent to the parking lot of a shopping plaza. At the NB approach, traffic from the driveways and parking lots frequently affected vehicles traveling at the NB approach, resulting in additional queues and vehicle-stops not caused by the traffic signal. Since the stop and queuing information play key roles in the estimation, the analysis for the NB traffic was excluded considering the noises caused by the traffic from the parking lot.

Figure 9A:
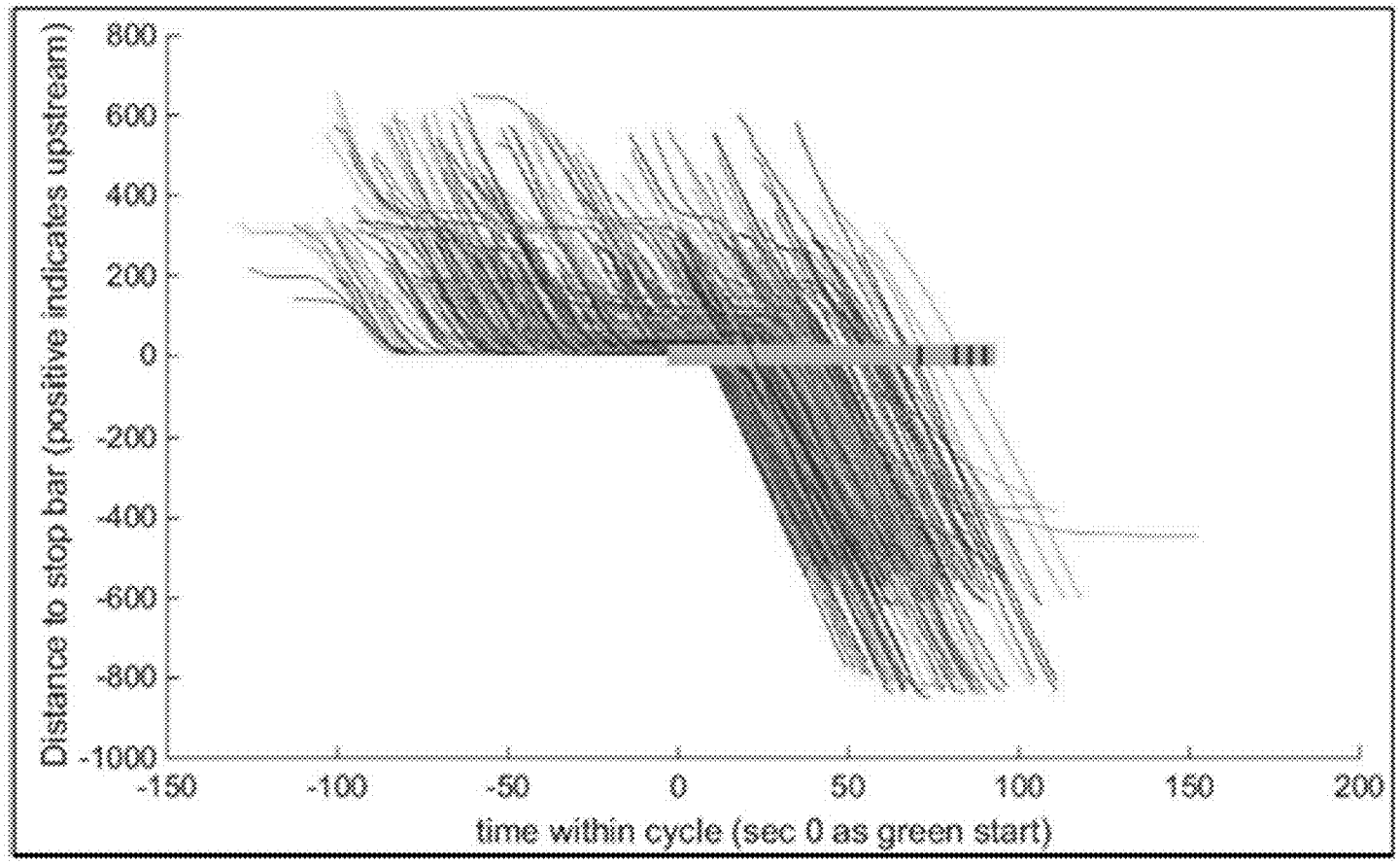
FIGS. 9A and 9B depict sample CV trajectories and time dependent factor for east-bound movement through the intersection of FIG. 8.

For each interested approach, trajectories of CVs were first processed as time-space plots with time as the horizontal axis and distance to the stop bar as the vertical axis. The trajectories are shown in FIG. 9A. With the SCOOT adaptive signal system, at this intersection, the cycle length, red and green duration all varied from cycle to cycle. To select a common reference point in a signal cycle, the start of green as time 0 is used in the plot for simplicity.

Figure 9B:
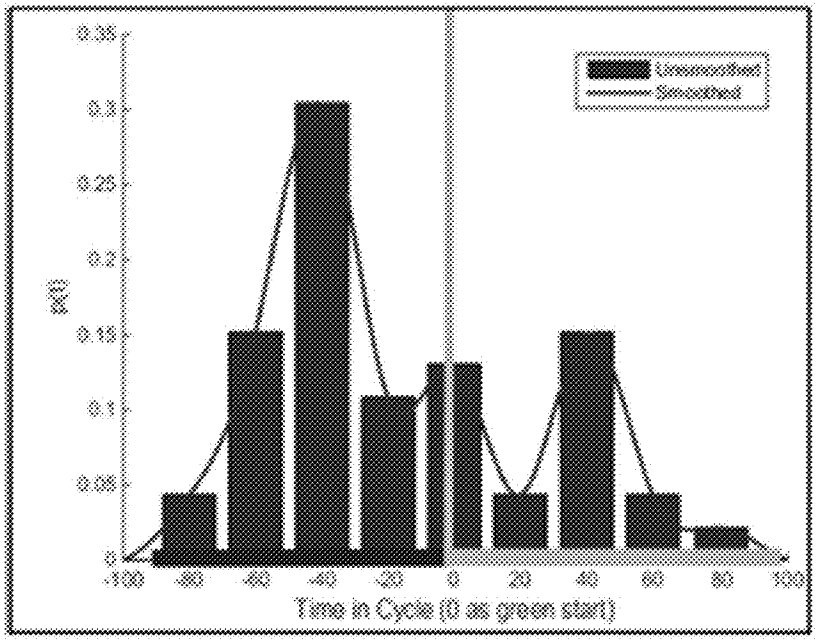
Figure 9B:
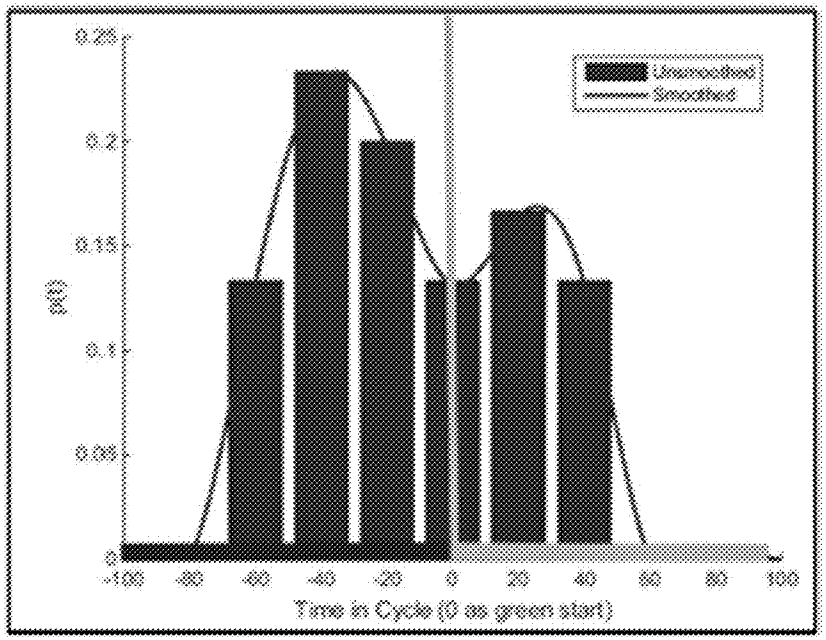

The CV trajectories were aggregated according to different TOD periods with 1-hour intervals across different days, to first calculate time-dependent factors p(t). For different TOD periods, substantially different p(t) were observed with two examples shown in FIG. 9B. The differences in p(t) should be due to differences in both traffic patterns and signal settings in the two different TOD periods. Along with p(t), observation lists were also prepared based on the CV trajectories. Finally, the EM procedure was implemented for the estimation.

Figure 10:
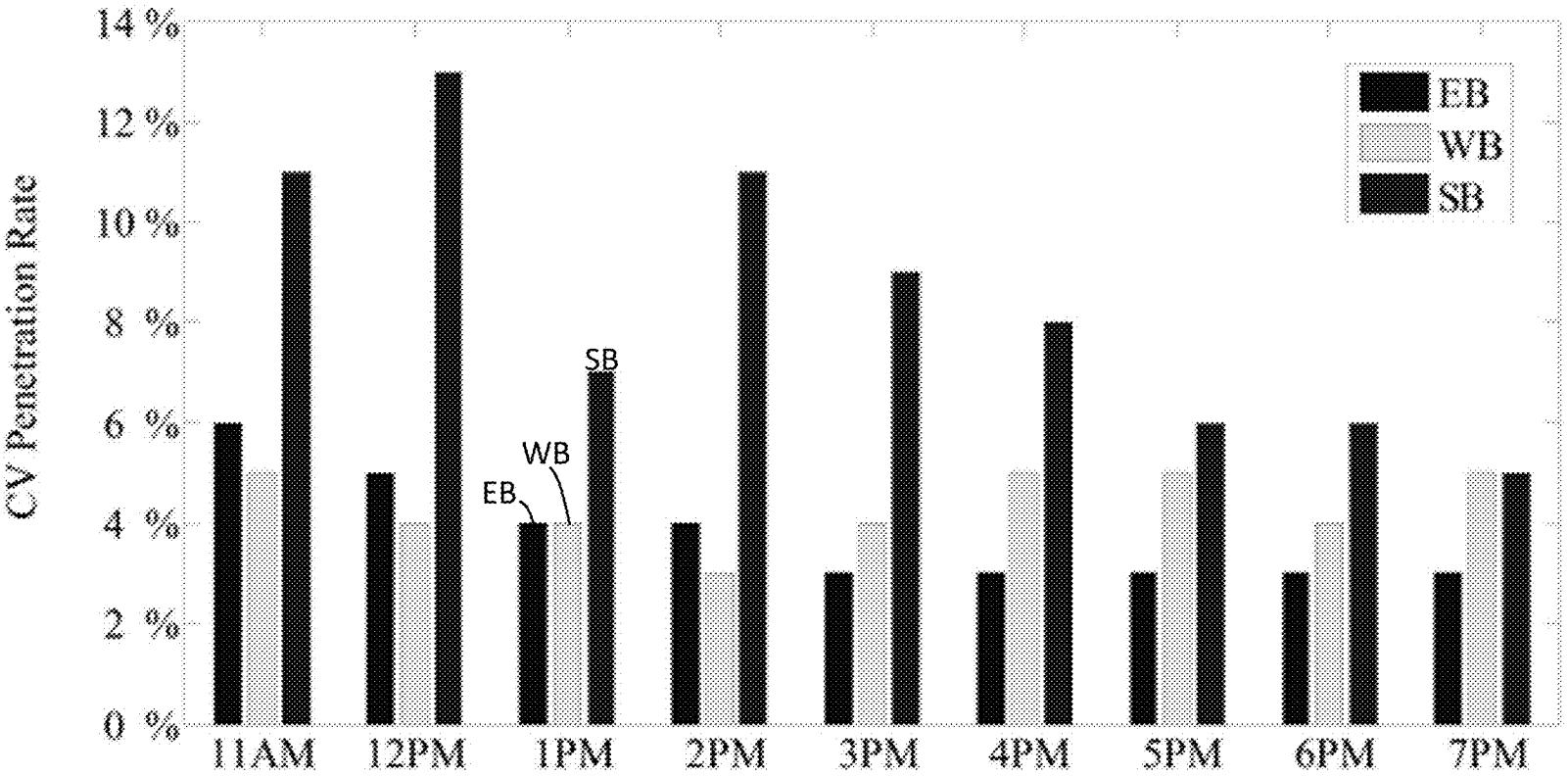
FIG. 10 depicts the CV penetration rates for east-bound, west-bound, and south-bound traffic through the intersection of FIG. 8.

For validation purpose, hourly volumes were also manually collected for two days, i.e., Apr. 25, 2016 and Apr. 26, 2016, from 11:00 AM to 7:00 PM. Using the measured volumes, the penetration rates of CVs were calculated, shown in FIG. 10. Overall, the penetration rates ranged from 3% to 12%, varying over the selected periods. The rates also varied substantially at different approaches, with lower CV penetration rates at the EB and WB approach, i.e., the main approaches, and higher rates at the SB approach, a minor approach. This variation could be due to that the SB approach connects to residential areas close to the University of Michigan that have larger population of participants of the SPMD project.

Figure 11A:
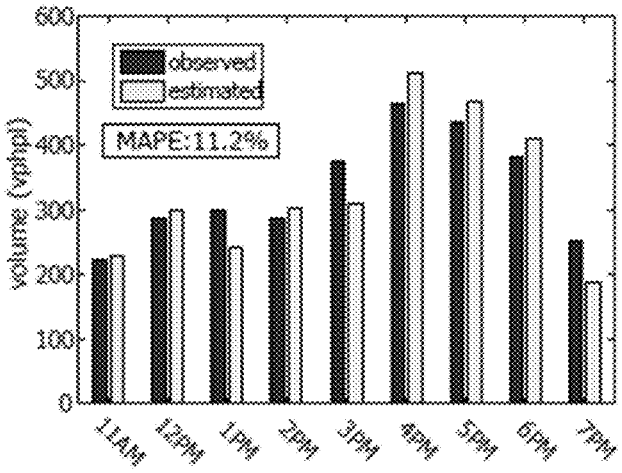
FIGS. 11A, 11B, and 11C depict a comparison of the observed and estimated traffic volumes through the intersection of FIG. 8 for east-bound, west-bound, and south-bound vehicles, respectively.
Figure 11B:
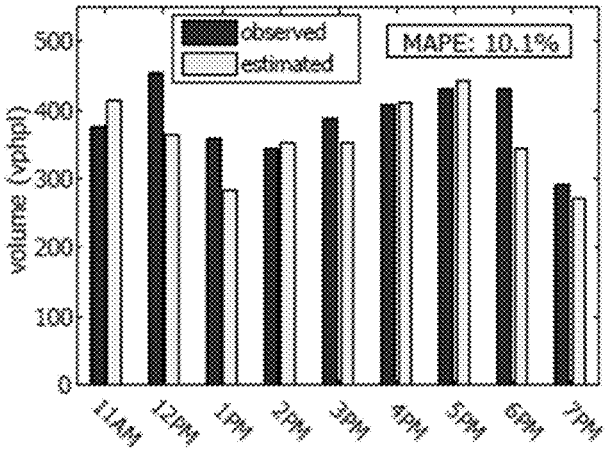
Figure 11C:
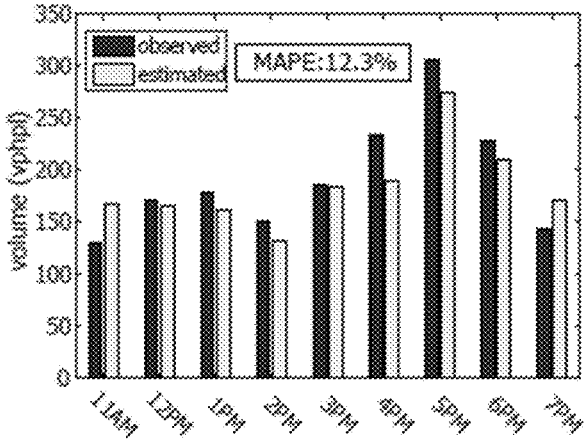

The observed volumes were then used for comparing with the estimated volumes, with results shown in FIGS. 11A-11C. To quantify the accuracy, the Mean Absolute Percentage Error (MAPE) was calculated for the estimation based on the following formula, indicated as well in the figures.

$$MAPE = \frac{1}{N} \frac{|Vol_{o,i} - Vol_{e,i}|}{Vol_{o,i}} \quad \text{(Equation 8)}$$

Where: $Vol_{o,i}$ is the observed volume, and $Vol_{e,i}$ is the estimated volume, during i-th interval.

As shown in the figures, the estimated volumes are generally close to the observed volumes over different TOD periods. The MAPEs are 11.2%, 10.1% and 12.3% for EB, WB and SB approach, respectively, indicating reasonable accuracy of the proposed procedure. Among the 3 approaches, however, the estimation for the SB approach performs the worst among all three phases, despite the largest CV penetration rates. This is likely due to that the arrival patterns are more stable at the EB and WB approaches with signal coordination, than that at the SB approach, i.e., a minor approach. Additionally, with the lowest traffic volumes at the SB approach, the total number of observed CV trajectories at the SB approach is similar to that at the EB and WB approach, which could imply that the sample size may also play a role rather than the penetration rate alone. Nonetheless, the results are still useful even though the overall penetration rates were low—mostly under 10% in the investigated cases.

Case Study 2

In the second case study, data was collected from drivers using a navigation service in China. The data was collected on workdays between Jun. 13, 2016 and Jun. 30, 2016 on a selected road. For the analysis, the proposed procedure used a selected approach at an intersection and estimated traffic volumes. The estimation was then validated using data from loop detectors for the approach.

Figure 12:
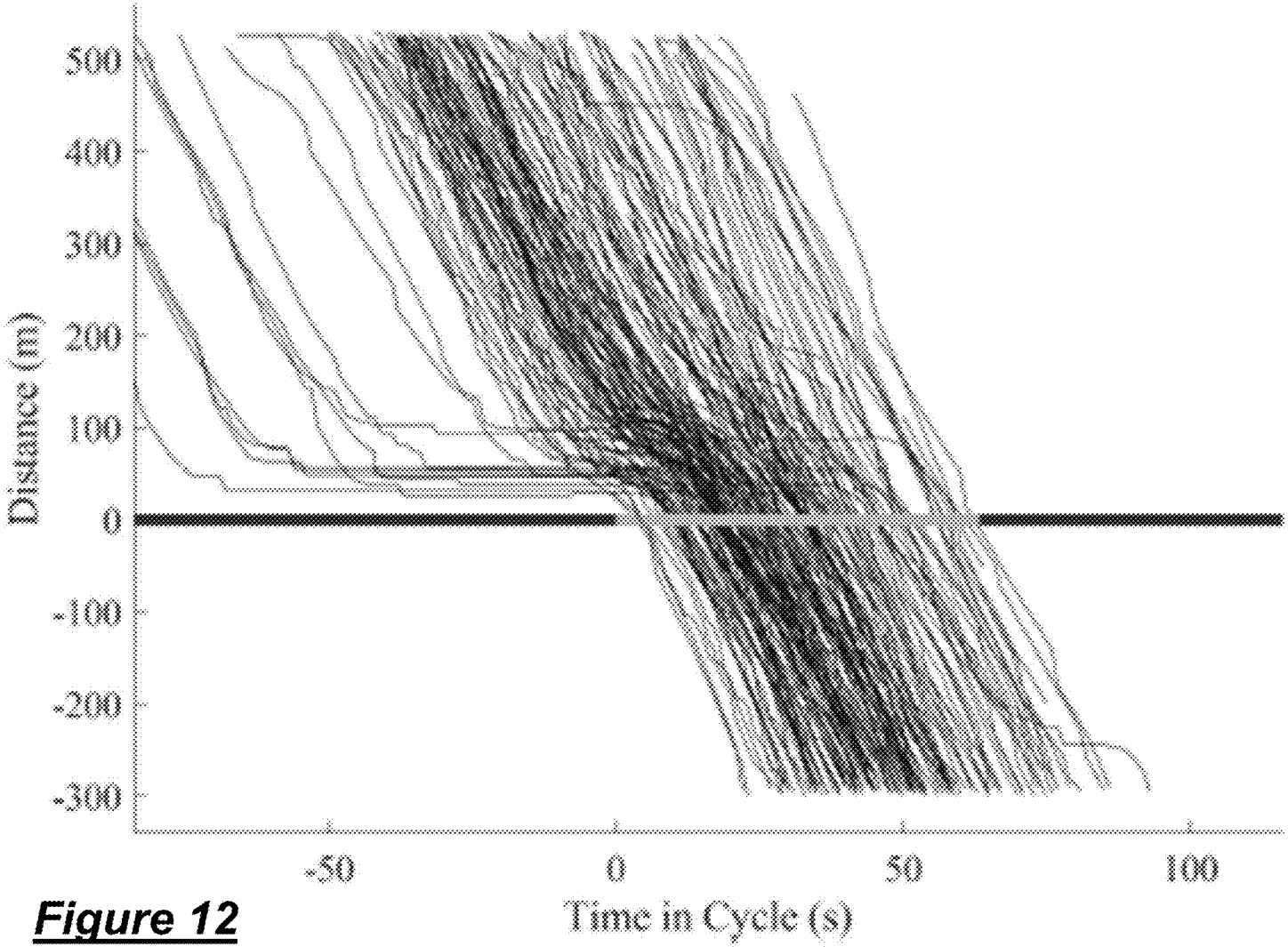
FIG. 12 depicts trajectories of vehicles through an intersection of a second selected sample intersection.

At one of the selected intersections, a sample set of the GPS trajectories between the adjacent upstream and downstream intersections for the through movement is shown in FIG. 12. The time of each GPS data point was also converted to time within a signal cycle.

Figure 13:
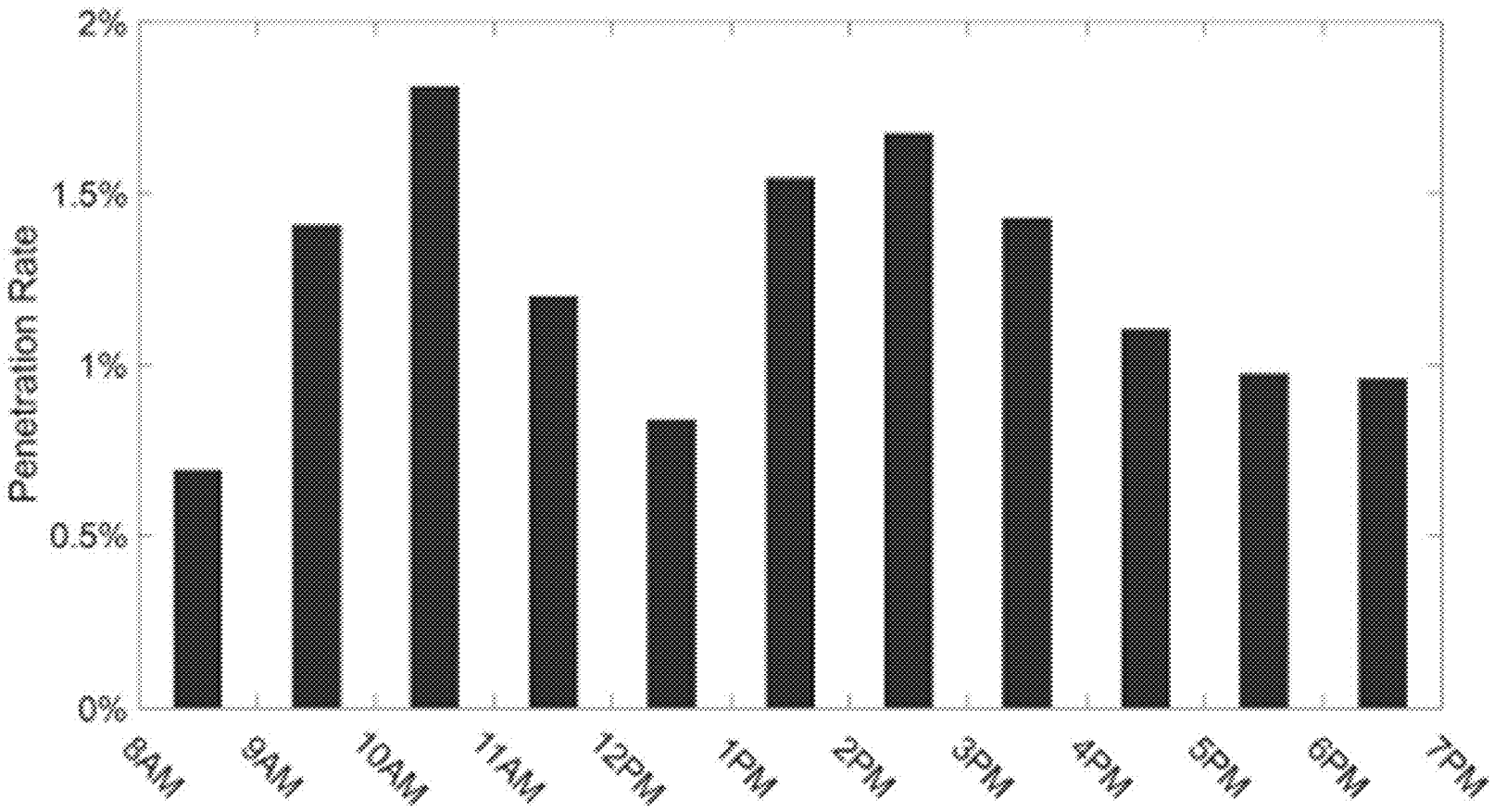
FIG. 13 shows the penetration rates of the vehicles through the second selected sample intersection.

For validation purposes, volume data were also obtained for the selected approach from loop detectors on Jul. 12, 2016. Based on the detector data, the penetration rates of the navigation users were calculated for the through movement. The results are shown in FIG. 13. While the penetration rate varied over time of day, generally, it stayed within the range of 0.5% to 2%.

Figure 14:
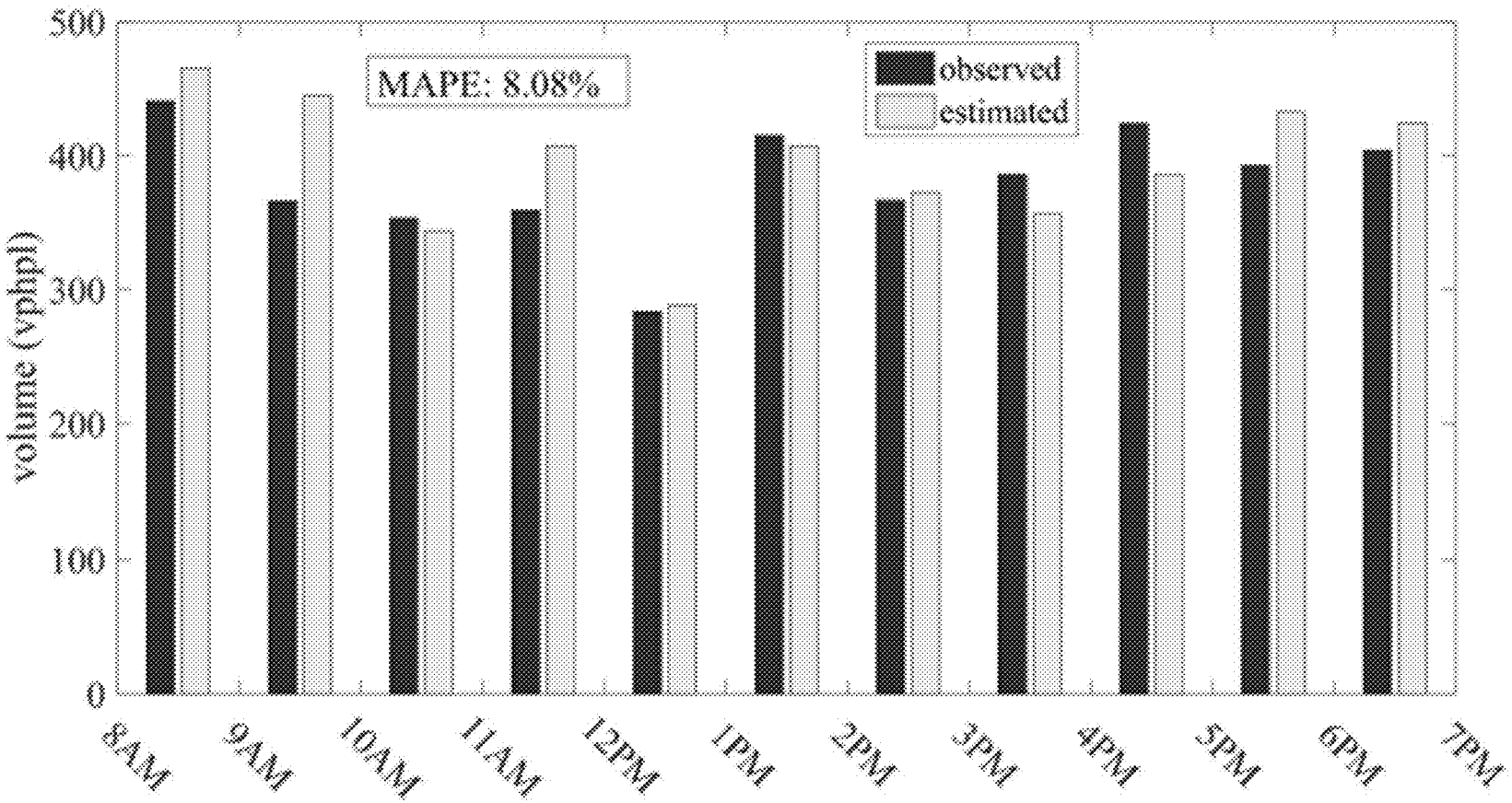
FIG. 14 depicts a comparison of the observed and estimated traffic volumes through the second selected sample intersection.

The volume estimation results are shown in FIG. 14. Similar to Case Study 1, the estimated volumes are generally close to the observed volumes. The MAPE of the estimation is 8.1% for the selected approach. The estimation errors in Case Study 2 are even smaller than those in Case Study 1, despite lower penetration rates. This may be due to the fact that the traffic signal in Case Study 2 was in a fixed-timed mode, while the signal in Case Study 1 was controlled by the SCOOT adaptive control system. Therefore, the cyclical profiles or the arrival types in Case Study 2 are more consistent than those in Case Study 1, hence yielding estimation results with less error.

To illustrate the use of the estimated volume data for assisting signal operation, the same procedure was repeated for four other intersections along the selected road and a time-space diagram (TS-Diagram) was generated based on the estimated volumes with the time dependent factors. The TS-Diagram is a convenient and popular tool for traffic engineers to evaluate performance of signal coordination, and to fine-tune signal settings if necessary. The result is shown in FIG. 15 for the selected corridor with the 5 intersections for time period 8 AM-9 AM.

Figure 15:
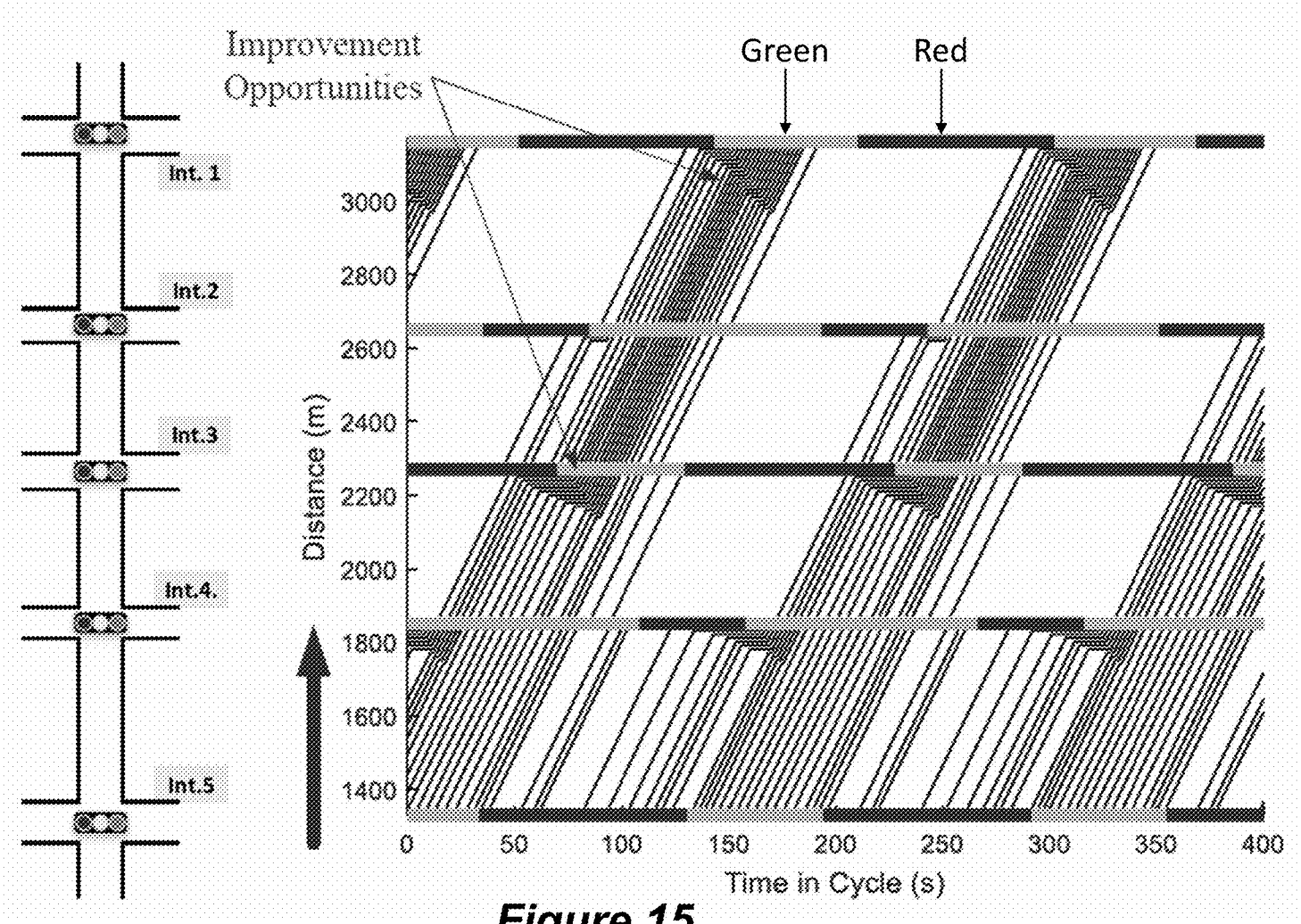
FIG. 15 depicts a space-time diagram of vehicle trajectories through a succession of five intersections.

From FIG. 15, it can be seen that, in general, the signals were coordinated well with traffic traveling in free-flow speed for the most of the time. However, for Int. 1 and Int. 3, vehicle delay exist and could potentially be reduced by adjusting offsets at these two intersections, indicating improvement opportunities at these two intersections.

As discussed above, these traffic volume estimations may be generated based on TL data received from connected vehicles (CVs). In one embodiment, there is provided a method for use in controlling traffic signaling devices located along public roadways, including the steps of: (a) receiving, at one or more computers, time-location (TL) data from a plurality of wirelessly connected devices traveling through an intersection of a public roadway; (b) determining, by the one or more computers using the received TL data, a traffic volume estimation value representative of a volume of traffic at the intersection; and (c) sending the traffic volume estimation value to a traffic signaling control system configured to control a traffic signaling device at the intersection based on the traffic volume estimation value.

Additionally, this embodiment may further include the step of receiving, at one or more of the computers, a status of a traffic signaling device located along the roadway; and wherein step (b) further comprises determining, using the one or more computers, the traffic volume estimation value at the intersection based on the received TL data and on the received status of the traffic signaling device. In other embodiments, step (b) can further include determining a trajectory through the intersection for each of at least some of the wirelessly connected devices and determining the traffic volume estimation value based on the trajectories. Additionally, in some embodiments, the determined trajectories may each include a projected arrival time at the intersection, a departure time from the intersection, and a stop event indicator that indicates whether the vehicle stops at the intersection or moves through the intersection without stopping, and wherein step (b) further includes determining the traffic volume estimation value using the arrival time, departure time, and stop event indicator for at least some of the wirelessly connected devices. Also, at least in some embodiments, at least some of the wirelessly connected devices are vehicles traveling through the intersection and wherein step (b) further includes determining the positions of some of the vehicles when stopped at the intersection and determining the traffic volume estimation value at least in part based on the positions.

In some embodiments, at least some of the wirelessly connected devices are vehicles traveling through the intersection and wherein step (b) further includes: determining an event type for each of at least some of the vehicles, wherein the event type comprises either one of: the vehicle stopping at the intersection; or the vehicle passing through the intersection without stopping, and determining the traffic volume estimation value based at least in part on the event type. Also, in at least one embodiment, the event type can include one of: the vehicle stopping at the intersection; the vehicle passing through the intersection without stopping; the vehicle stopping at the intersection after another vehicle passes through the intersection without stopping during a single traffic light cycle; or the vehicle passing through the intersection without stopping after another vehicle passes through the intersection without stopping during a single traffic light cycle. In other embodiments, step (a) can further include the step of receiving, for each of the wirelessly connected devices, the TL data as a series of trackpoints, each having location coordinates derived from global navigation satellite system (GNSS) radio signals along with time data indicating when the device was at a location represented by the location coordinates.

As used herein, a traffic volume estimation value can be an estimation of traffic volume for a particular area or for a particular traffic signal and that may be based or determined using any one or more of the steps, algorithms, or equations discussed above.

In another embodiment, there is provided a method for use in controlling traffic signaling devices located along public roadways, including the steps of: (a) receiving global navigation satellite system (GNSS) information that includes location and time data at a remote facility from a plurality of connected vehicles traveling along roadways that are interconnected at intersections; (b) using the GNSS information to determine a trajectory for each of at least some of the plurality of connected vehicles; (c) receiving a set of traffic signal statuses, wherein the set of traffic signal statuses indicate the traffic signal status for traffic signals at least some of the intersections, and wherein the one or more traffic signal statuses are each associated with a status time value; (d) associating the trajectories with the set of traffic signal statuses according to the status time value and the time data from the GNSS information; and (e) determining a traffic volume estimation value based on the associated trajectories and set of traffic signal statuses.

As used herein, a set of traffic signal statuses is one or more traffic signal statuses. Each of these statuses may include an associated time value (e.g., a timestamp, or a start timestamp and an end timestamp) in which the status corresponds to. For example, one traffic signal status may be a "red" light signal and may be associated with a time value of 9:00:00 AM (start time of status) to 9:01:00 AM (end time of status).

The trajectories can be associated with the traffic signal statuses of traffic signals at the intersections through which the trajectories pass according to the status time value and the time data from the GNSS information. In some embodiments, the determined trajectory for each vehicle may include a projected arrival time at the intersections traversed by the vehicle, a departure time from the traversed intersections, and a stop event indicator that indicates whether the vehicle stops at the traversed intersections or moves through the traversed intersections without stopping, and wherein step (e) further comprises determining the traffic volume estimation value using the arrival time, departure time, and stop event indicator for at least some of the wirelessly connected devices. Also, step (e) may comprise determining the positions of some of the vehicles when stopped at the intersections through which the vehicles' trajectories pass and determining the traffic volume estimation value at least in part based on the positions. It may also further comprise: (i) determining an event type for each of at least some of the vehicles, wherein the event type comprises either one of: the vehicle stopping at the intersections through which the trajectories pass; or the vehicle passing through those intersections without stopping, and (ii) determining the traffic volume estimation value based at least in part on the event type. The event type may comprise one of: the vehicle stopping at the intersection; the vehicle passing through the intersection without stopping; the vehicle stopping at the intersection following another vehicle passes through the intersection without stopping during a single traffic light cycle; or the vehicle passing through the intersection without stopping after another vehicle passes through the intersection without stopping during a single traffic light cycle.

In other embodiments, a plurality of TL data in the form of GNSS information for each connected vehicle may be received from a plurality of vehicles or other mobile devices, the plurality of GNSS information may then be compiled to form trajectory data for each of the plurality of vehicles, and then the trajectory may be used along with traffic signal status information according to the algorithms discussed above. Once traffic volume estimations are calculated, the traffic volume estimations can be sent to a municipal facility, which can then use the traffic volume estimations as a basis for traffic signal operation. In some embodiments, once the municipal facility determines the traffic signal operation, the municipal facility may remotely program the traffic signal through use of land network 14, cellular carrier system 12, or other radio signals.

Any one or more servers, computers, or other computing devices at remote facility 16 or municipal facility 18 can be configured to operate according to one or more of the algorithms discussed above, including any one or more of Equations 1 to 8, or other equations discussed above. In one embodiment, a server that includes a processor and a memory device that is located at remote facility 16 may be configured to carry out any one or more of the steps above, including one or more of the appropriate algorithms as described above.

Additionally, in some embodiments, TL data may be received from mobile devices at the remote facility, which may then use such data to estimate pedestrian or other relevant traffic volumes. This can be particularly useful in areas of high pedestrian traffic. In addition, mobile devices that are carried by a user on a personal mobility device, such as a bicycle or rollerblades, may send GNSS information or other TL data to a remote facility that can then use such data according to the method discussed herein.

Although certain embodiments discussed above refer to carrying out at least part of the method discussed herein at remote facility 16, other embodiments may carry out these steps and/or other steps at municipal facility 18. In yet another embodiment, traffic signal 22, vehicles 10, 11, and/or mobile device 60 may carry out one or more of the steps discussed herein.

It is to be understood that the foregoing description is of one or more embodiments of the invention. The invention is not limited to the particular embodiment(s) disclosed herein, but rather is defined solely by the claims below. Furthermore, the statements contained in the foregoing description relate to the disclosed embodiment(s) and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method for use in controlling traffic signaling devices located along public roadways, comprising the steps of:

(a) receiving, at one or more computers, time-location (TL) data from a plurality of wirelessly connected devices traveling through an intersection of a public roadway;

(b) determining, by the one or more computers using the received TL data, a traffic volume estimation value representative of a volume of traffic at the intersection by:

determining a trajectory through the intersection for each of at least two of the wirelessly connected devices, wherein the at least two wirelessly connected devices includes a plurality of vehicles;

determining an event type for each of the plurality of vehicles, wherein the event type comprises either one of: the vehicle stopping at the intersection; or the vehicle passing through the intersection without stopping; and determining the traffic volume estimation value based at least in part on the event type and the trajectory for each of the plurality of vehicles; and (c) sending the traffic volume estimation value to a traffic signaling control system configured to control a traffic signaling device at the intersection based on the traffic volume estimation value.

2. The method of claim 1, further comprising the step of receiving, at one or more of the computers, a status of a traffic signaling device located along the roadway; and wherein step (b) further comprises determining, using the one or more computers, the traffic volume estimation value at the intersection based on the received TL data and on the received status of the traffic signaling device.

3. The method of claim 1, wherein the determined trajectory includes a projected arrival time at the intersection, a departure time from the intersection, and a stop event indicator that indicates whether the vehicle stops at the intersection or moves through the intersection without stopping, and wherein step (b) further comprises determining the traffic volume estimation value using the arrival time, departure time, and stop event indicator for at least some of the wirelessly connected devices.

4. The method of claim 1, wherein step (b) further comprises determining the positions of some of the vehicles when stopped at the intersection and determining the traffic volume estimation value at least in part based on the positions.

5. The method of claim 1, wherein the event type comprises one of: the vehicle stopping at the intersection; the vehicle passing through the intersection without stopping; the vehicle stopping at the intersection after another vehicle passes through the intersection without stopping during a single traffic light cycle; or the vehicle passing through the intersection without stopping after another vehicle passes through the intersection without stopping during a single traffic light cycle.

6. The method of claim 1, wherein step (a) further comprises receiving, for each of the wirelessly connected devices, the TL data as a series of trackpoints, each having location coordinates derived from global navigation satellite system (GNSS) radio signals along with time data indicating when the device was at a location represented by the location coordinates.

7. A computer-based system for use in controlling traffic signaling devices located along public roadways, comprising one or more computers that include one or more electronic processors and one or more computer programs stored on non-transitory computer-readable medium, the one or more computer programs being configured upon execution by the one or more processors to:

(a) receive time-location (TL) data from a plurality of wirelessly connected devices traveling through an intersection of a public roadway;

(b) determine using the received TL data, a traffic volume estimation value representative of a volume of traffic at the intersection by:

determining a trajectory through the intersection for each of at least two of the wirelessly connected devices, wherein the at least two wirelessly connected devices includes a plurality of vehicles;

determining an event type for each of the plurality of vehicles, wherein the event type comprises either one of: the vehicle stopping at the intersection; or the vehicle passing through the intersection without stopping; and determining the traffic volume estimation value based at least in part on the event type and the trajectory for each of the plurality of vehicles; and (c) send the traffic volume estimation value to a traffic signaling control system configured to control a traffic signaling device at the intersection based on the traffic volume estimation value.

8. A method for use in controlling traffic signaling devices located along public roadways, comprising the steps of:

(a) receiving global navigation satellite system (GNSS) information that includes location and time data at a remote facility from a plurality of connected vehicles traveling along roadways that are interconnected at intersections;

(b) determining, for each of at least some of the plurality of connected vehicles, a trajectory using the GNSS information, wherein the determined trajectory for each vehicle includes a projected arrival time at the intersections traversed by the vehicle, a departure time from the traversed intersections, and a stop event indicator that indicates whether the vehicle stops at the traversed intersections or moves through the traversed intersections without stopping;

(c) receiving a set of traffic signal statuses, wherein the set of traffic signal statuses indicate the traffic signal status for traffic signals at two or more of the intersections, and wherein the one or more traffic signal statuses are each associated with a status time value;

(d) associating the trajectories with the set of traffic signal statuses for traffic signals at the two or more intersections through which the trajectories pass according to the status time value and the time data from the GNSS information; and (e) determining a traffic volume estimation value based on the associated trajectories and set of traffic signal statuses, wherein the traffic volume estimation value is determined using the arrival time, departure time, and stop event indicator for two or more of the connected vehicles.

9. The method of claim 8, wherein step (e) further comprises determining the positions of some of the vehicles when stopped at the intersections through which the vehicles' trajectories pass and determining the traffic volume estimation value at least in part based on the positions.

10. The method of claim 8, wherein step (e) further comprises:

determining an event type for each of at least some of the vehicles, wherein the event type comprises either one of: the vehicle stopping at the intersections through which the trajectories pass; or the vehicle passing through those intersections without stopping, and determining the traffic volume estimation value based at least in part on the event type.

11. The method of claim 10, wherein the event type comprises one of: the vehicle stopping at the intersection; the vehicle passing through the intersection without stopping; the vehicle stopping at the intersection following another vehicle passes through the intersection without stopping during a single traffic light cycle; or the vehicle passing through the intersection without stopping after another vehicle passes through the intersection without stopping during a single traffic light cycle.

12. The method of claim 8, where step (e) further comprises sending the traffic volume estimation value to a traffic signaling control system configured to control traffic signals at the intersections through which the trajectories pass based on the traffic volume estimation value.

* * * * *